US009165544B2

(12) United States Patent
Yoshino

(10) Patent No.: US 9,165,544 B2
(45) Date of Patent: Oct. 20, 2015

(54) ELECTRONIC CYMBAL

(71) Applicant: ROLAND CORPORATION, Shizuoka (JP)

(72) Inventor: Kiyoshi Yoshino, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 0 days.

(21) Appl. No.: 14/513,223

(22) Filed: Oct. 14, 2014

(65) Prior Publication Data

US 2015/0179159 A1 Jun. 25, 2015

(30) Foreign Application Priority Data

Dec. 25, 2013 (JP) ..... 2013-266427

(51) Int. Cl.
*G10H 3/14* (2006.01)

(52) U.S. Cl.
CPC ..... *G10H 3/146* (2013.01); *G10H 2230/321* (2013.01)

(58) Field of Classification Search
IPC ..... G10H 3/146,2230/321
See application file for complete search history.

(56) References Cited

U.S. PATENT DOCUMENTS

| | | | | |
|---|---|---|---|---|
| 3,509,264 | A * | 4/1970 | Green | 84/725 |
| 5,262,585 | A | 11/1993 | Greene et al. | |
| 5,965,834 | A * | 10/1999 | Suenaga et al. | 84/422.3 |
| 9,053,693 | B1 * | 6/2015 | Wei | 1/1 |
| 9,099,072 | B2 * | 8/2015 | Yoshino | 1/1 |
| 2002/0059861 | A1 * | 5/2002 | Yoshino et al. | 84/402 |
| 2003/0200860 | A1 | 10/2003 | Toda | |
| 2004/0016339 | A1 | 1/2004 | Yoshino et al. | |
| 2005/0039593 | A1 * | 2/2005 | Wachter | 84/730 |
| 2005/0145101 | A1 * | 7/2005 | Yoshino | 84/723 |
| 2006/0096448 | A1 * | 5/2006 | Yoshino et al. | 84/734 |
| 2006/0156910 | A1 * | 7/2006 | Yoshino | 84/723 |
| 2012/0048099 | A1 * | 3/2012 | Wissmuller | 84/723 |
| 2012/0060669 | A1 | 3/2012 | Ryan et al. | |

(Continued)

FOREIGN PATENT DOCUMENTS

| | | |
|---|---|---|
| EP | 0855698 | 7/1998 |
| JP | H10-207451 | 8/1998 |

(Continued)

OTHER PUBLICATIONS

"The Extended European Search Report", issued on May 7, 2015, p. 1-p. 4.

*Primary Examiner* — David Warren
(74) *Attorney, Agent, or Firm* — Jianq Chyun IP Office

(57) ABSTRACT

An electronic cymbal, comprising: an annular portion in an annular shape having predetermined rigidity; a central portion having predetermined rigidity, located on an inner circumferential side of the annular portion and configured separately from the annular portion; a sensor portion comprising a first sensor that detects displacement of the central portion; a support supporting the sensor portion while swingably maintaining the central portion; and an interposed member formed of a film, installed between a lower surface of the central portion and the sensor portion while elastically deformably supported by the support, wherein by displacing the central portion from a motionless state, the sensor portion is pressed by an outer circumferential part of the central portion via the interposed member.

20 Claims, 10 Drawing Sheets

(56) References Cited

U.S. PATENT DOCUMENTS

| | | | | |
|---|---|---|---|---|
| 2013/0047826 | A1* | 2/2013 | Wissmuller | 84/723 |
| 2013/0125735 | A1* | 5/2013 | Mori | 84/723 |
| 2013/0312590 | A1* | 11/2013 | Truchsess | 84/725 |
| 2014/0260897 | A1* | 9/2014 | Miyashita | 84/422.3 |

FOREIGN PATENT DOCUMENTS

| | | |
|---|---|---|
| JP | 2002-062872 | 2/2002 |
| JP | 2002-207481 | 7/2002 |
| JP | 2003-316355 | 11/2003 |
| JP | 2009-128807 | 6/2009 |

* cited by examiner

ELECTRONIC CYMBAL

CROSS-REFERENCE TO RELATED APPLICATION

This application claims the priority benefit of Japan application serial no. 2013-266427, filed on Dec. 25, 2013. The entirety of the above-mentioned patent application is hereby incorporated by reference herein and made a part of this specification.

BACKGROUND OF THE INVENTION

1. Field of the Invention

The present invention relates to an electronic cymbal. Particularly, the present invention relates to an electronic cymbal capable of improving detection accuracy for a strike.

2. Description of Related Art

An electronic cymbal that simulates an acoustic cymbal includes a sensor for detecting a struck position.

Patent Literature 1 discloses an electronic pad (electronic cymbal) including a cup portion 30 (central portion), an edge portion 32 and a bow portion 31. In the electronic pad (electronic cymbal), if a cup portion sheet sensor 8 (first sensor) is pressed by the cup portion 30, the cup portion sheet sensor 8 detects a strike to the cup portion 30.

Here, in the above conventional electronic pad, a part of a cover 2 that presses the cup portion sheet sensor 8 is required to exhibit high flatness in order to improve detection accuracy for a strike.

Meanwhile, the cup portion 30 is formed by insert-molding a core material 19 in the cover 2 having elasticity. Consequently, the cover 2 is vulcanization-molded while the core material 19 is placed within the mold. Then, in some cases, the core material 19 is deformed by a pressure applied to the mold, and the cover 2 is molded in the state that the core material 19 has been deformed. In such case, when the molded cover 2 and the core material 19 are removed from the mold, the core material 19 returns to its shape before being deformed. Accordingly, the molded cover 2 also changes in shape. Hence, the part that presses the cup portion sheet sensor 8 has reduced flatness.

In this way, for the conventional electronic pad, it is difficult to ensure the flatness of the cover 2 after molding. If the cover 2 of which flatness is not sufficiently achieved is used, detection accuracy for a strike is reduced.

PRIOR-ART LITERATURE

Patent Literature

Patent Literature 1: Japanese Patent Publication No. 2002-207481 (Paragraphs [0038]-[0039], FIGS. 1 and 2, etc.)

SUMMARY OF THE INVENTION

The present invention is intended to provide an electronic cymbal capable of improving the detection accuracy for a strike in order to solve the above-mentioned problem.

According to an electronic cymbal of a technical solution of the present application, a central portion is displaced with respect to a support, and the central portion presses a sensor portion via an interposed member. Consequently, the sensor portion detects a strike to the central portion.

The interposed member here is formed of a film. Hence, flatness of a part that touches the sensor portion with the displacement of the central portion can be easily ensured compared to a case where the interposed member is formed of a rubbery elastic body formed by insert molding. That is, the detection accuracy for a strike to the central portion can be improved.

According to an electronic cymbal of another technical solution of the present application, when the central portion is in a motionless state, the interposed member touches the central portion. Accordingly, in addition to the effect of the electronic cymbal of the aforesaid technical solution, swinging of the interposed member can be suppressed.

That is, when a part of the interposed member that touches the central portion is pressed by the central portion to be elastically deformed, a reaction force generated by the elastic deformation of the interposed member acts in a direction of pushing back the central portion. Thus, when the central portion is in the motionless state, the interposed member can remain touching the central portion, i.e., the interposed member can remain spaced from the sensor portion. That is, a first sensor can be suppressed from performing false detection.

According to an electronic cymbal of another technical solution of the present application, the support includes a first restricting portion and a second restricting portion. Here, the first restricting portion restricts displacement of the first sensor in a direction perpendicular to a height direction. The second restricting portion restricts displacement of the interposed member in the direction perpendicular to the height direction. Accordingly, in addition to the effect of the electronic cymbal of the aforesaid technical solution, relative displacement of the interposed member and the sensor portion in the direction perpendicular to the height direction can be prevented. Thus, during a performance, relative positional deviation between the interposed member and the sensor portion can be prevented. In this way, the interposed member can remain installed between the sensor portion and the central portion. As a result, the detection accuracy for a strike to the central portion can be ensured.

According to an electronic cymbal of another technical solution of the present application, an elastic member is disposed on an upper surface side of the first sensor. Accordingly, in addition to the effect of the electronic cymbal of the aforesaid technical solution, when the central portion is displaced, the interposed member can touch the elastic member. Consequently, the first sensor is pressed by the central portion via the elastic member and the interposed member. Thus, an impact on the first sensor accompanying the pressing operation by the central portion can be relieved. That is, damage to the first sensor can be suppressed.

In addition, by properly setting elasticity of the elastic member or a space between the elastic member and the interposed member, sensitivity of the first sensor or the reaction force of the interposed member generated by elastic deformation can be adjusted.

According to an electronic cymbal of another technical solution of the present application, when the central portion is in the motionless state, a space between a displacement restricting portion and the interposed member is set wider than the space between the elastic member and the interposed member. Accordingly, in addition to the effect of the electronic cymbal of the aforesaid technical solution, when the central portion is displaced, the interposed member can press the elastic member. Meanwhile, when the central portion is in the motionless state, the space between the displacement restricting portion and the interposed member is set narrower than a space between the first sensor and the interposed member. Thus, the interposed member can touch the displacement restricting portion before touching the first sensor.

Accordingly, a contact between the interposed member and the first sensor can be prevented, and the impact on the first sensor accompanying the pressing operation by the central portion can be reduced. That is, damage to the first sensor can be prevented.

According to an electronic cymbal of another technical solution of the present application, the first sensor is disposed on an outer circumferential side of a protruding portion, and a height of the sensor portion from the bottom is lower than a height of the protruding portion from the bottom. Accordingly, in addition to the effect of the electronic cymbal of the aforesaid technical solution, by disposing the interposed member on an upper end of the protruding portion, the interposed member can be supported while spaced from the sensor portion. Thus, a mounting process of the sensor portion and the interposed member onto the support can be simplified.

In addition, when an outer circumferential part of the interposed member projecting outward from the protruding portion is pressed by the central portion, the outer circumferential part is pushed down while a lower surface side of the interposed member is supported by the protruding portion, and the interposed member is elastically deformed. Thus, the reaction force that acts in the direction of pushing back the central portion can be increased.

Consequently, when a stick or the like leaves the central portion to thereby terminate the pressing operation on the first sensor by the central portion, the interposed member can be quickly separated from the sensor portion due to the reaction force. As a result, the detection accuracy for a strike to the central portion can be improved.

According to an electronic cymbal of another technical solution of the present application, in addition to the effect of the electronic cymbal of the aforesaid technical solution, intensity of a strike to the central portion or a bow portion can be detected by a second sensor.

Further, a first frame having an insertion portion that allows insertion of a cymbal stand thereinto and a second frame are connected by a connection portion formed of an elastic material. Thus, vibration transmitted from the cymbal stand to the first frame can be attenuated by the connection portion. As a result, transmission of vibration from the cymbal stand to the second frame can be reduced. Therefore, the second sensor can be suppressed from performing false detection of the vibration of the cymbal stand.

According to an electronic cymbal of another technical solution of the present application, the support that swingably supports the central portion is connected to the bow portion. Accordingly, in addition to the effect of the electronic cymbal of the aforesaid technical solution, the support supports the central portion in a relatively displaceable manner. In addition, the support and the bow portion are connected by the connection portion. As a result, the member that connects the support to the bow portion can be made common with the member that connects the first frame to the second frame. Thus, a number of members of the electronic cymbal can be decreased.

According to an electronic cymbal of another technical solution of the present application, a jack is attached to the first frame. Accordingly, in addition to the effect of the electronic cymbal of the aforesaid technical solution, vibration transmitted to the first frame from a connector cable connected to the jack can be less transmitted to the second frame due to the connection portion. Consequently, transmission of vibration from the connector cable to the second frame can be reduced. That is, the second sensor can be suppressed from performing false detection of the vibration of the connector cable.

DESCRIPTION OF THE EMBODIMENTS

Figure 1A:
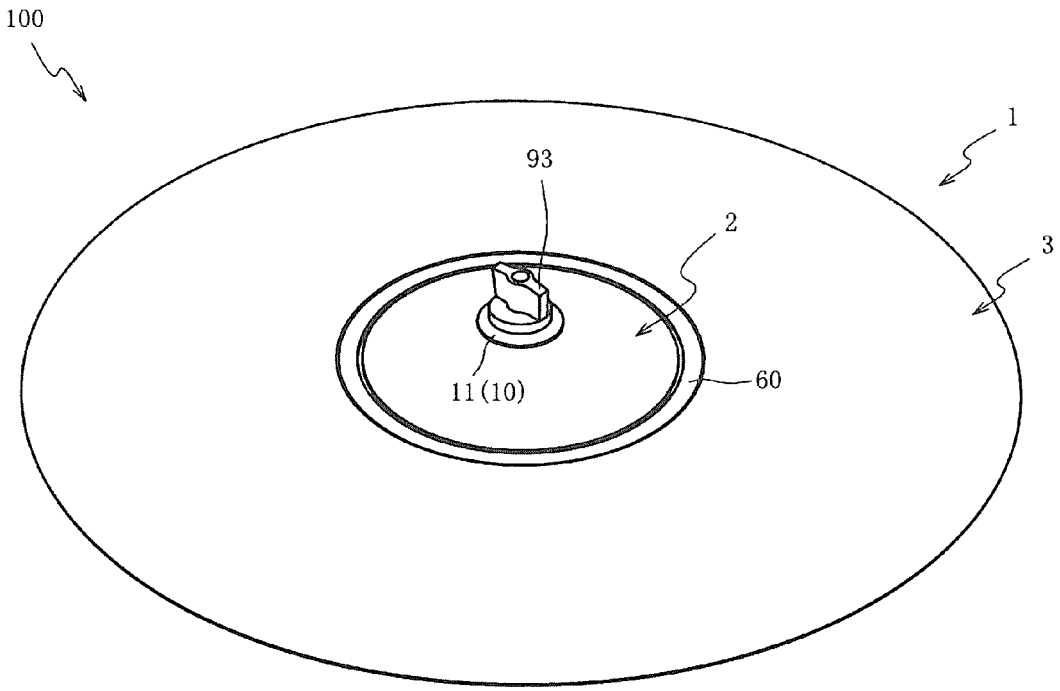
FIG. 1A is a perspective view of an electronic cymbal according to the first embodiment of the present invention as viewed from an upper surface side.
Figure 1B:
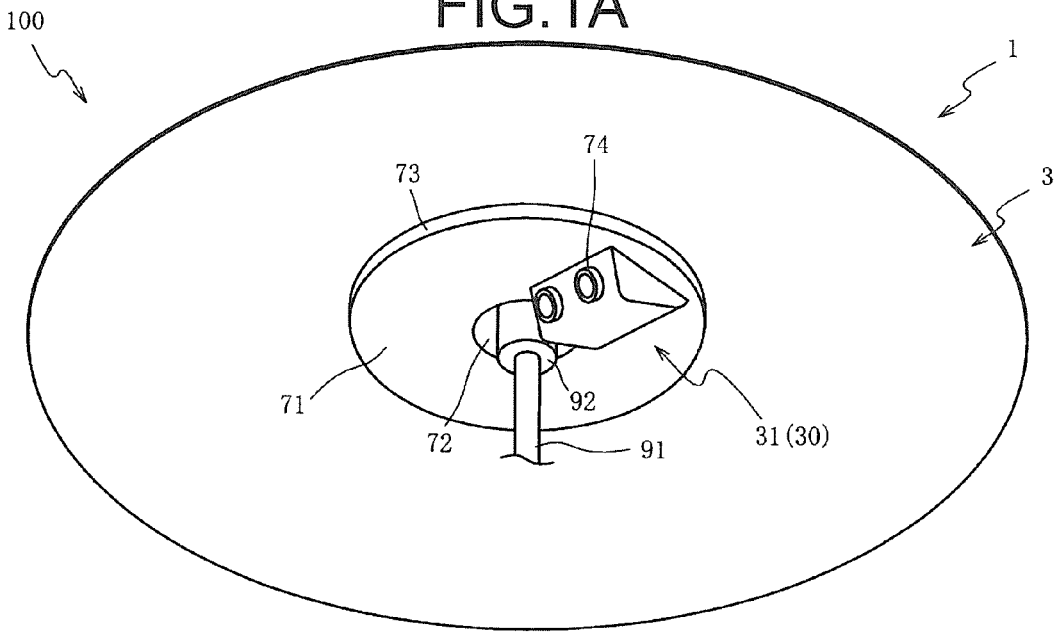
FIG. 1B is a perspective view of the electronic cymbal as viewed from a lower surface side.

Preferred embodiments of the present invention are described hereinafter in detail with reference to the accompanying drawings. First, a schematic configuration of an electronic cymbal 100 according to the first embodiment is described with reference to FIGS. 1A and 1B. FIG. 1A is a perspective view of the electronic cymbal 100 according to the first embodiment of the present invention as viewed from an upper surface side. FIG. 1B is a perspective view of the electronic cymbal 100 as viewed from a lower surface side.

As shown in FIGS. 1A and 1B, the electronic cymbal 100 is an electronic percussion instrument that simulates an acoustic cymbal. The electronic cymbal 100 mainly includes the main body portion 1, a first sensor 41 and a second sensor 42 (see FIGS. 3A and 3B). The main body portion 1 is to be struck by a performer. The first sensor 41 and the second sensor 42 detect that the main body portion 1 is struck.

When the main body portion 1 of the electronic cymbal 100 is struck by a stick or the like, the struck position or intensity of the strike are detected by the first sensor 41 and the second sensor 42 or the like. The first sensor 41 and the second sensor 42 are electrically connected to a sound source apparatus (not illustrated) through a jack 74 (see FIG. 3A) and a connector cable (not illustrated). The sound source apparatus controls a sound source based on detection signals outputted from the first sensor 41 and the second sensor 42 or the like, so as to generate a musical sound according to the strike to the main body portion 1.

Figure 2A:
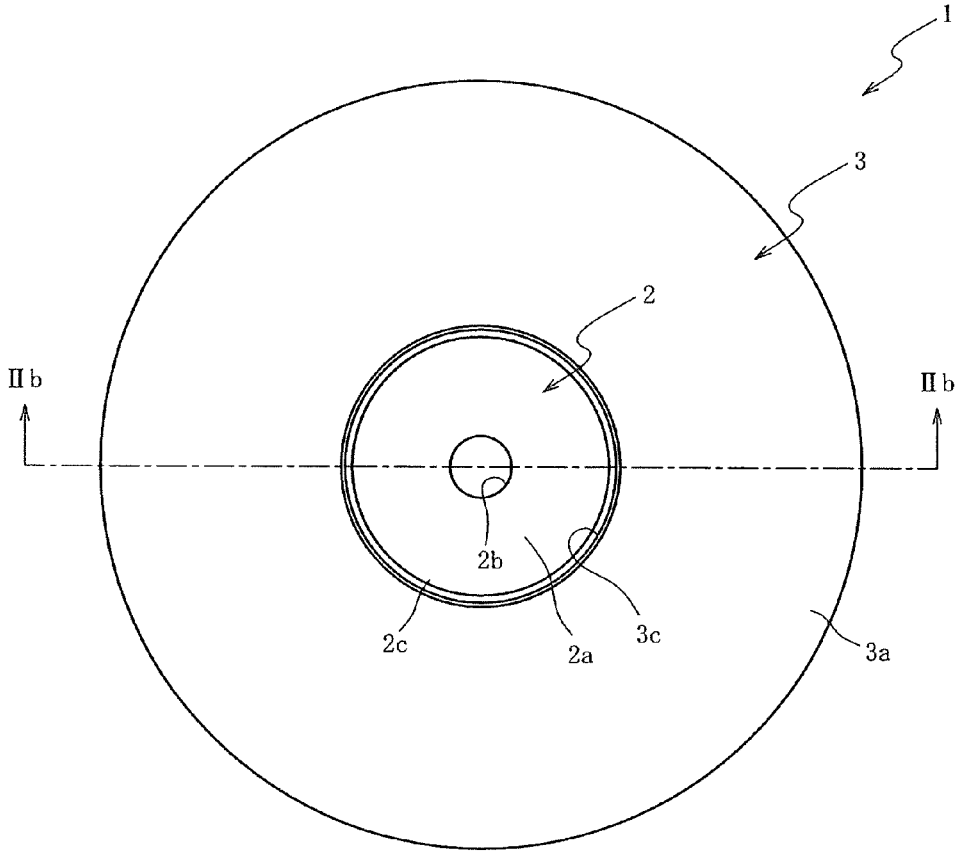
FIG. 2A is a top view of a main body portion.
Figure 2B:
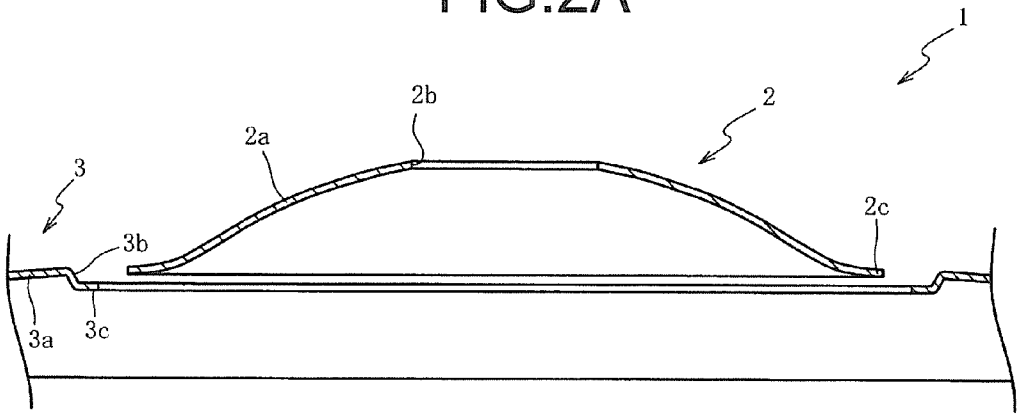
FIG. 2B is a cross-sectional view of the main body portion taken on line IIb-IIb in FIG. 2A.

Next, the main body portion 1 is described with reference to FIGS. 2A and 2B. FIG. 2A is a top view of the main body portion 1. FIG. 2B is a cross-sectional view of the main body portion 1 taken on line in FIG. 2A.

As shown in FIGS. 2A and 2B, the main body portion 1 is formed like an acoustic cymbal as a whole. The main body portion 1 is a part made of metal. The main body portion 1 includes a central portion 2 and an annular portion 3. The central portion 2 is disposed at a center part of the main body portion 1. The annular portion 3 is disposed on an outer circumferential side of the central portion 2.

The central portion 2 includes a bell portion 2*a*, an insertion hole 2*b* and a bell extension portion 2*c*. The bell portion 2*a* is formed in a bowl shape inclined downward and radially outward. The insertion hole 2*b* is drilled into a center part of the bell portion 2*a*. The bell extension portion 2*c* is installed to extend radially outward from an outer circumferential part of the bell portion 2*a*.

The bell portion 2*a* is a part to be struck by the performer with a stick or the like. The insertion hole 2*b* is a hole into which a rod 91*a* (see FIG. 3A) of a cymbal stand 91 is inserted. The bell extension portion 2*c* is an annular part radially outward from the outer circumferential part of the bell portion 2*a* and inclined downward more gradually than the bell portion 2*a*.

The annular portion 3 includes a bow portion 3*a*, an inclined portion 3*b* and a bow extension portion 3*c*. The bow portion 3*a* is formed in an annular shape inclined downward from radially inward to radially outward and more gradually than the bell portion 2*a*. The inclined portion 3*b* is formed by bending on an inner circumferential part of the bow portion 3*a*. Further, the inclined portion 3*b* is formed in a tapered shape inclined downward and radially inward of the annular portion 3. The bow extension portion 3*c* is formed by bending on an inner circumferential part of the inclined portion 3*b*. Further, the bow extension portion 3*c* is installed to extend horizontally (in a direction perpendicular to an axial direction of the annular portion 3, horizontal direction and direction perpendicular to the paper surface of FIG. 2B) and radially inward of the annular portion 3. Since the inclined portion 3*b* is formed by bending on the inner circumferential part of the bow portion 3*a*, rigidity of the annular portion 3 is increased.

Moreover, materials other than metal that compose the electronic cymbal 100 are exemplified by resin materials with high rigidity such as PC (polycarbonate), ABS, FRP (fiber-reinforced plastics), etc.

Figure 3A:
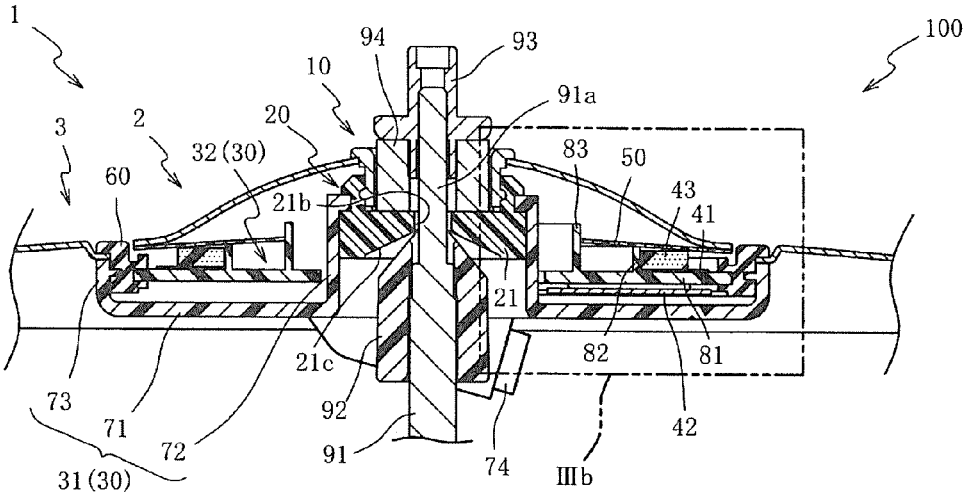
FIG. 3A is a cross-sectional view of an electronic cymbal.
Figure 3B:
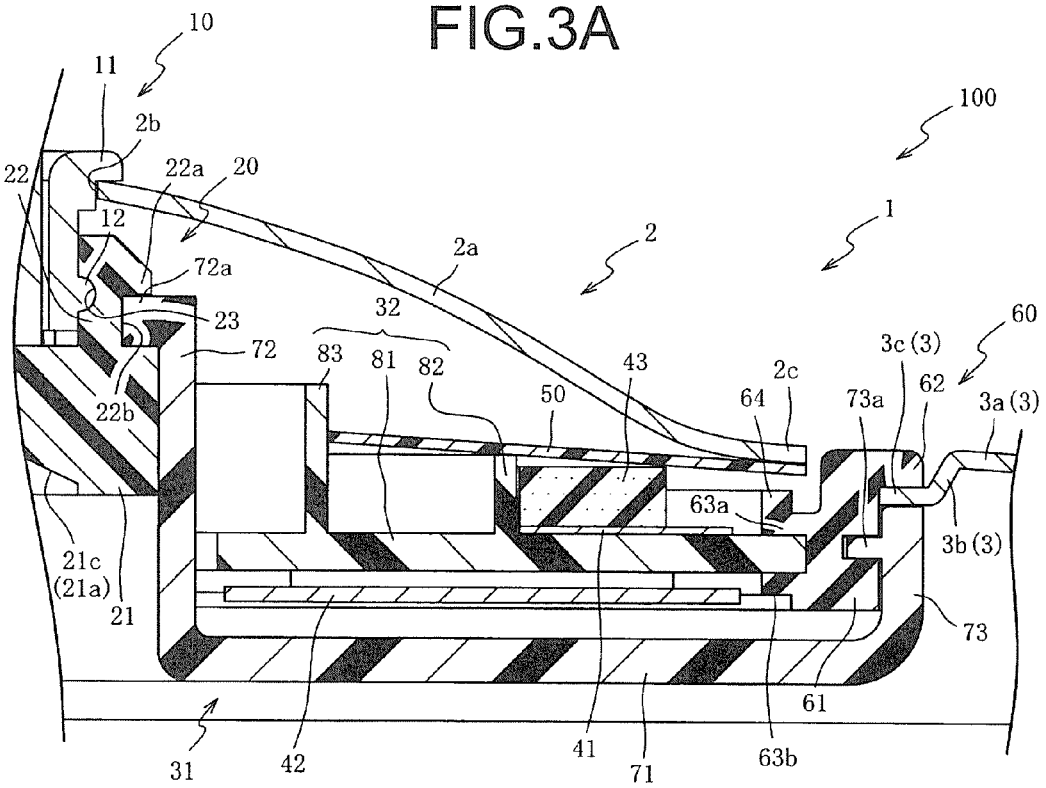
FIG. 3B is a partially enlarged cross-sectional view of the electronic cymbal taken on a part IIIb in FIG. 3A.
Figure 4:
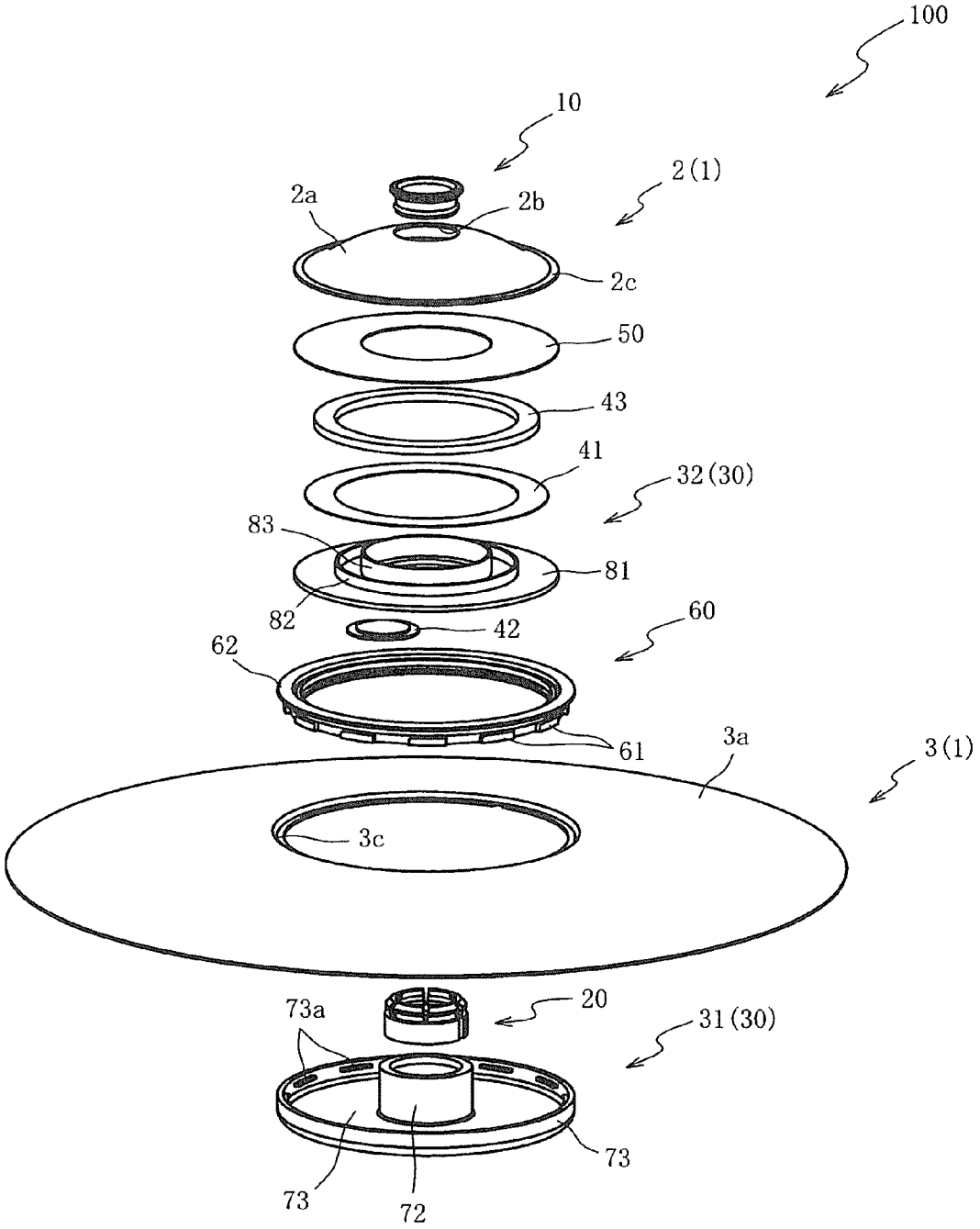
FIG. 4 is an exploded perspective view of the electronic cymbal.

Next, a detailed configuration of the electronic cymbal 100 is described with reference to FIG. 3A to FIG. 8C. FIG. 3A is a cross-sectional view of the electronic cymbal 100. FIG. 3B is a partially enlarged cross-sectional view of the electronic cymbal 100 taken on the part IIIb in FIG. 3A. FIG. 4 is an exploded perspective view of the electronic cymbal 100. Moreover, FIG. 3A illustrates a state that the electronic cymbal 100 is supported by the cymbal stand 91. FIG. 3A also schematically illustrates a cross section including an axial center of the electronic cymbal 100 and having the second sensor 42 cut off. Further, FIG. 3A omits illustration of a part of the annular portion 3. FIG. 3B omits illustration of the jack 74.

As shown in FIGS. 3A and 3B, generally, the electronic cymbal 100 is used while the rod 91*a* of the cymbal stand 91 is inserted thereinto. A cymbal support portion 92 is locked to the cymbal stand 91 while restricted from moving downward (lower side in FIG. 3A). An upper part (upper part in FIG. 3A) of the cymbal support portion 92 is formed in a tapered shape that tapers upward.

When the rod 91*a* is inserted into the electronic cymbal 100, a later-described second ring 20 is swingably locked to the cymbal support portion 92. In such state, a felt washer 94 is placed around the rod 91*a* from above the electronic cymbal 100. Then, the felt washer 94 is compressed while a tightening nut 93 is tightened from above the felt washer 94 into an external thread threaded on an upper part of the rod 91*a*. By doing so, the electronic cymbal 100 is fixed to the cymbal stand 91.

As shown in FIG. 4, the electronic cymbal 100 mainly includes the main body portion 1, a first ring 10, the second ring 20, a sensor accommodating portion 30, a first sensor 41, a second sensor 42, an elastic member 43, an interposed member 50 and a connection ring 60. The main body portion 1 is constituted by the central portion 2 and the annular portion 3. The first ring 10 fits the inside of the insertion hole 2*b* of the central portion 2 of the main body portion 1. The second ring 20 fits the outside of the first ring 10. The sensor accommodating portion 30 is disposed below the central portion 2 while fitting the outside of the second ring 20. The first sensor 41 and the second sensor 42 are accommodated by the sensor accommodating portion 30. The elastic member 43 is disposed on an upper surface side of the first sensor 41. The interposed member 50 is installed between the elastic member 43 and the central portion 2. The connection ring 60 connects the sensor accommodating portion 30 to the annular portion 3. The components of the electronic cymbal 100 are hereinafter described in detail with reference to FIG. 5A to FIG. 8C.

Figure 5A:
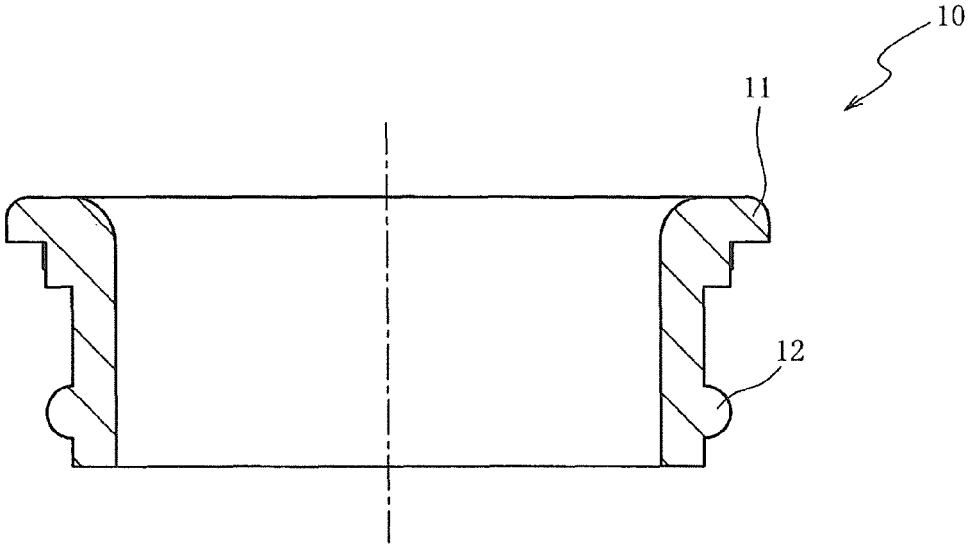
FIG. 5A is a cross-sectional view of a first ring.
Figure 5B:
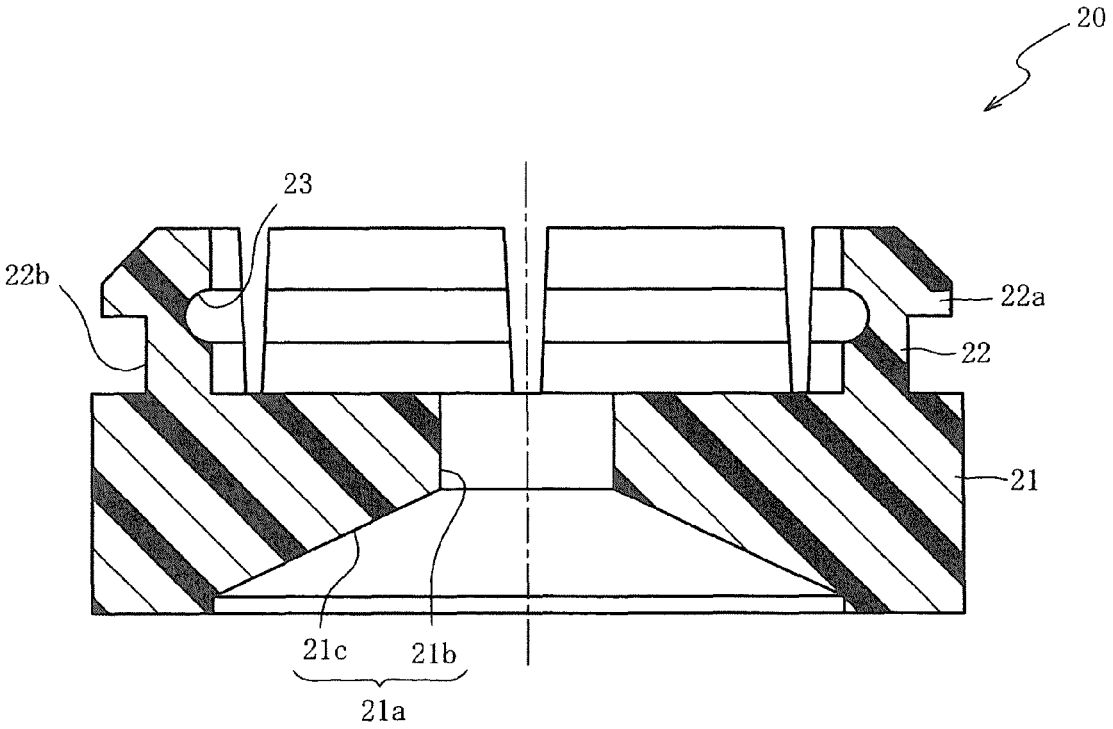
FIG. 5B is a cross-sectional view of a second ring.

First, the first ring 10 and the second ring 20 are described with reference to FIGS. 5A and 5B. FIG. 5A is a cross-sectional view of the first ring 10 and illustrates a cross section including an axial center of the first ring 10. FIG. 5B is a cross-sectional view of the second ring 20 and illustrates a cross section including an axial center of the second ring 20.

As shown in FIG. 5A, the first ring 10 is an annular member formed to allow insertion of the rod 91*a* (see FIG. 3A) thereinto. The first ring 10 includes a bell support portion 11 and a first convex portion 12. The bell support portion 11 is formed in a flange shape on one end side (upper side in FIG. 5A) in an axial direction of the first ring 10. The first convex portion 12 protrudes radially outward from an outer circumferential surface of the first ring 10 located lower than the bell support portion 11 and extends along a circumferential direction of the first ring 10.

The bell support portion 11 is constituted by two parts having different outer diameters. The smaller-diameter part of the two parts is formed at a lower side and has an outer diameter equal to an inner diameter of the insertion hole 2*b* (see FIG. 2B) of the central portion 2. Further, the greater-diameter part of the two parts is formed at an upper side and has an outer diameter greater than the inner diameter of the insertion hole 2*b*. Thus, when the first ring 10 fits the inside of the insertion hole 2*b*, the central portion 2 is swingably supported by the bell support portion 11 (see FIG. 3B).

As shown in FIG. 5B, the second ring 20 is an annular member formed to allow insertion of the rod 91*a* (see FIG. 3A) thereinto. The second ring 20 includes a swing portion 21, a plurality of upright portions 22 and a first concave portion 23. The swing portion 21 is swingably supported by the cymbal support portion 92 (see FIG. 3A). The plurality of the upright portions 22 are installed upright on an upper surface side of the swing portion 21. The first concave portion 23 is depressed on inner circumferential surfaces of the plurality of the upright portions 22.

The swing portion 21 includes a through hole 21*a* formed through its central part along an axial direction (vertical direction in FIG. 5B). A uniform diameter portion 21*b* and a tapered portion 21*c* are formed in the through hole 21*a*. The uniform diameter portion 21*b* is formed with a constant inner diameter at an upper part (upper part in FIG. 5B) of the through hole 21*a*. The tapered portion 21 *c* is installed consecutively below (lower side in FIG. 5B) the uniform diameter portion 21*b* and has a gradually expanding diameter from an upper side toward a lower side thereof in the swing portion 21.

The inner diameter of the uniform diameter portion 21*b* is greater than an outer diameter of the rod 91*a* and smaller than an outer diameter of the cymbal support portion 92. In addition, the greatest inner diameter of the tapered portion 21*c* is greater than the greatest outer diameter of the cymbal support portion 92. In the cross-sectional view shown by FIG. 3A, a lower surface (surface facing downward in FIG. 3A) of the tapered portion 21*c* has a greater inclination angle than the inclination angle of an upper surface (surface facing upward in FIG. 3A) of the cymbal support portion 92 opposed to the tapered portion 21 *c* with respect to an axial direction (vertical direction in FIG. 3A) of the rod 91*a*.

The plurality of the upright portions 22 are formed around an axial center of the tapered portion 21*c* (see FIG. 5B). A projected portion 22*a* is formed projecting radially outward on an upper end of the upright portion 22. In addition, the upright portion 22 includes a second concave portion 22*b* installed to extend along a circumferential direction of the upright portion 22. The second concave portion 22*b* is formed in a groove shape by an outer circumferential surface of the upright portion 22, a lower surface side of the projected portion 22*a* and the upper surface side of the swing portion 21.

The first concave portion 23 is formed in a groove shape such that the first convex portion 12 (see FIG. 5A) formed at the first ring 10 can fit thereinto. By pushing the plurality of the upright portions 22 to open radially outward so as to fit the first convex portion 12 into the first concave portion 23, the first ring 10 is connected to the second ring 20 (see FIG. 3B).

The sensor accommodating portion 30 is described with reference back to FIGS. 3A and 3B. The sensor accommodating portion 30 includes a first frame 31, and a second frame 32 configured separately from the first frame 31. The first frame 31 and the second frame 32 are connected to each other by the connection ring 60.

The first sensor 41, the elastic member 43 and the interposed member 50 are disposed on an upper surface side (surface at the upper side in FIG. 3B) of the second frame 32 opposed to a lower surface side of the central portion 2. Further, the second sensor 42 is pasted on a lower surface side (surface at the lower side in FIG. 3B) of the second frame 32.

Figure 6B:
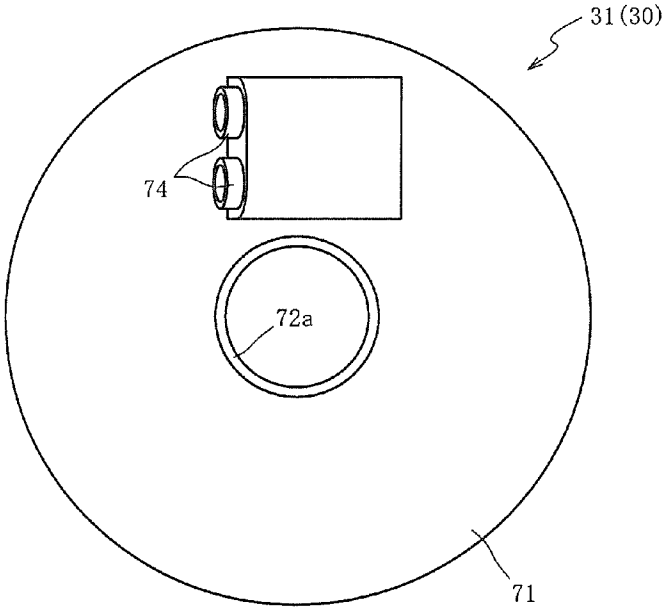
FIG. 6B is a bottom view of the first frame.
Figure 6A:
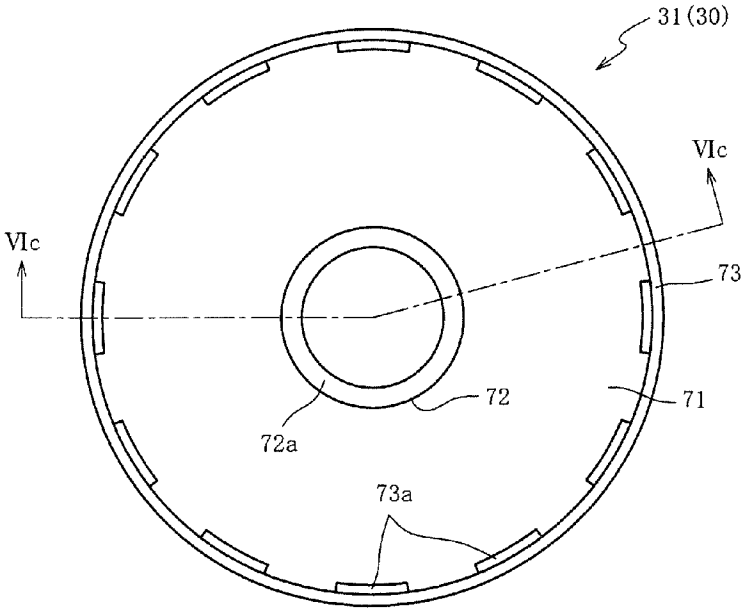
FIG. 6A is a top view of a first frame.
Figure 6C:
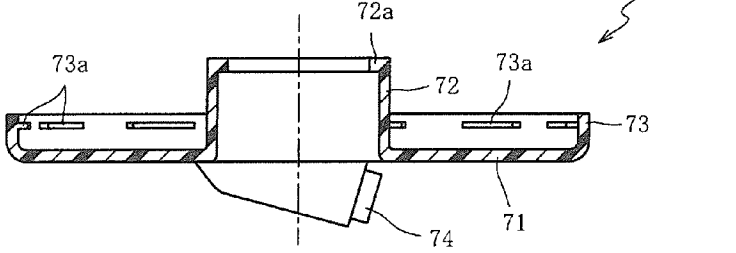
FIG. 6C is a cross-sectional view of the first frame taken on line VIc-VIc in FIG. 6A.

Here, the first frame 31 is described with reference to FIGS. 6A to 6C. FIG. 6A is a top view of the first frame 31. FIG. 6B is a bottom view of the first frame 31. FIG. 6C is a cross-sectional view of the first frame 31 taken on line VIc-VIc in FIG. 6A.

The first frame 31 is a member formed of a resin material. As shown in FIG. 6A, the first frame 31 includes a first bottom portion 71, an inner circumferential upright portion 72 and an outer circumferential upright portion 73. The first bottom portion 71 is an annular part disposed opposite to the lower surface side of the central portion 2. The inner circumferential upright portion 72 is installed upright on an inner circumferential part of the first bottom portion 71. The outer circumferential upright portion 73 is installed upright on an outer circumferential part of the first bottom portion 71.

A part of the first bottom portion 71 protrudes downward, and the jack 74 is disposed at the protruding part. The jack 74 electrically connects the first sensor 41 and the second sensor 42 to one end of a connector cable (not illustrated). To simplify the drawing, the jack 74 is schematically illustrated in FIG. 6C.

The inner circumferential upright portion 72 is formed in a cylindrical shape. A second convex portion 72*a* is formed projecting radially inward from an upper end part of the inner circumferential upright portion 72.

The second convex portion 72*a* is formed to fit into the second concave portion 22*b* (see FIG. 5B) of the second ring 20. By fitting the second convex portion 72*a* into the second concave portion 22*b*, the first frame 31 is connected to the second ring 20.

The outer circumferential upright portion 73 has an inner diameter equal to an inner diameter of the bow extension portion 3*c* (see FIG. 2B) of the annular portion 3. In addition, a plurality of inner circumferential convex portions 73*a* are formed protruding radially inward from an inner circumferential surface of the outer circumferential upright portion 73 while extending circumferentially. Further, the plurality of the inner circumferential convex portions 73*a* are formed circumferentially in an equally spaced manner.

Figure 7A:
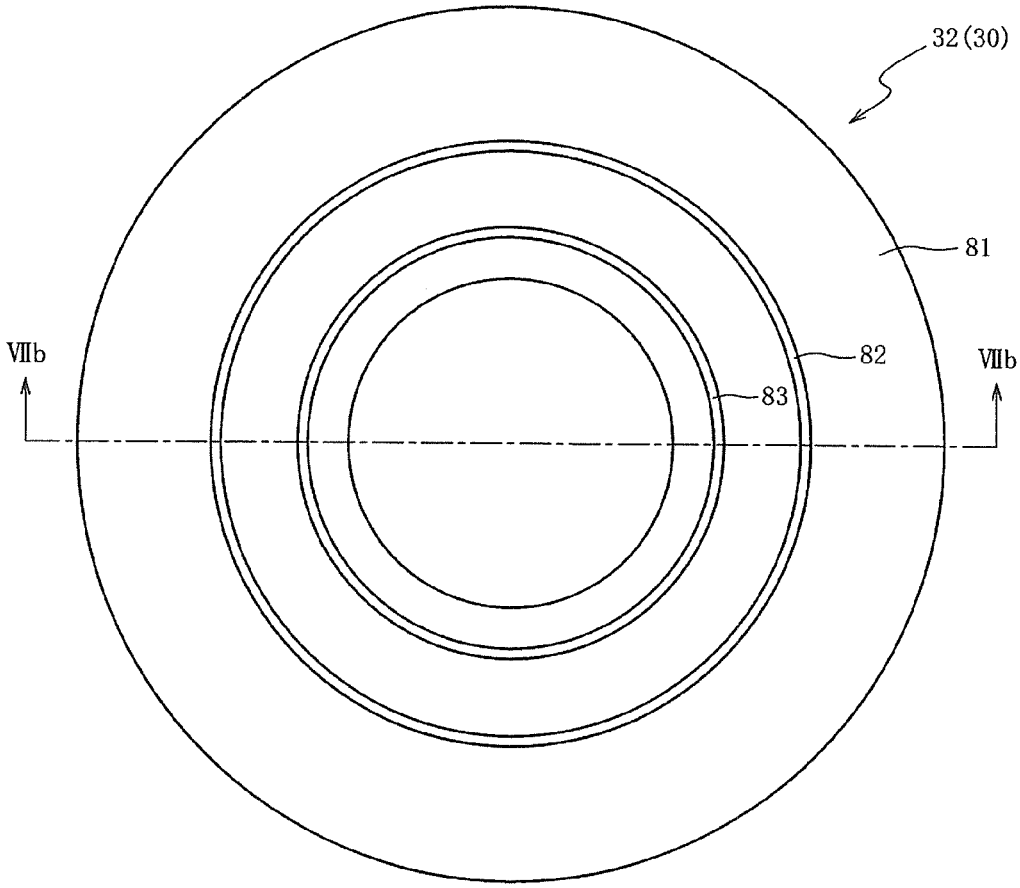
FIG. 7A is a top view of a second frame.
Figure 7B:
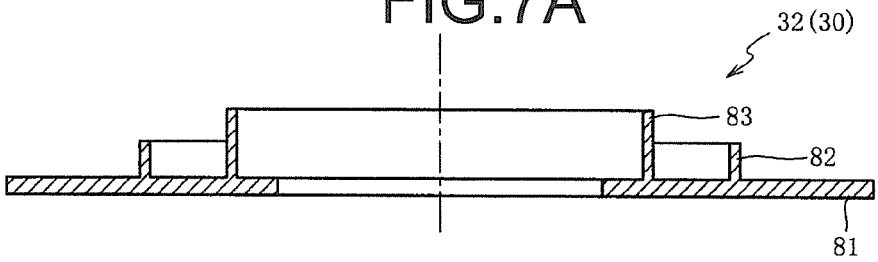
FIG. 7B is a cross-sectional view of the second frame taken on line VIIb-VIIb in FIG. 7A.
Figure 7C:
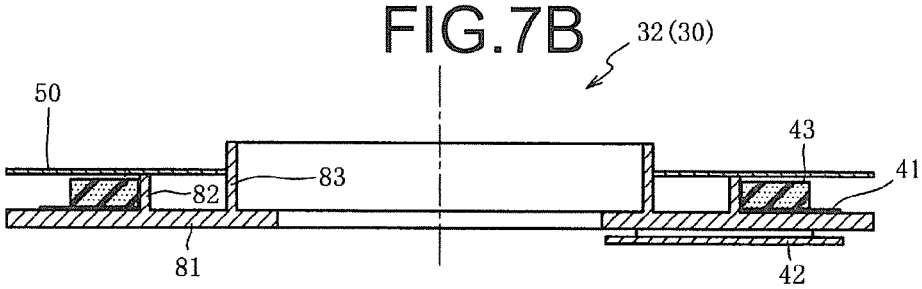
FIG. 7C is a cross-sectional view of the second frame with a first sensor, an elastic member, an interposed member and a second sensor disposed thereon.

Next, the second frame 32, the first sensor 41, the elastic member 43, the interposed member 50 and the second sensor 42 are described in order with reference to FIGS. 7A to 7C. FIG. 7A is a top view of the second frame 32. FIG. 7B is a cross-sectional view of the second frame 32 taken on line VIIb-VIIb in FIG. 7A. FIG. 7C is a cross-sectional view of the second frame 32 with the first sensor 41, the elastic member 43, the interposed member 50 and the second sensor 42 disposed thereon. Moreover, FIG. 7C illustrates the cross section corresponding to that shown in FIG. 7B.

The second frame 32 is a member formed of a resin material. As shown in FIGS. 7A and 7B, the second frame 32 includes a second bottom portion 81, a first rib 82 and a second rib 83. The second bottom portion 81 is an annular part. The first rib 82 is installed upright on an upper surface side of the second bottom portion 81. The second rib 83 is installed upright on the upper surface side of the second bottom portion 81 located on an inner circumferential side of the first rib 82.

The second bottom portion 81 is formed to be accommodated between the inner circumferential upright portion 72 and the outer circumferential upright portion 73 of the first frame 31. The second bottom portion 81 has an inner diameter greater than an outer diameter of the inner circumferential upright portion 72 of the first frame 31. In addition, the second bottom portion 81 has an outer diameter smaller than an inner diameter of the outer circumferential upright portion 73 of the first frame 31. The outer diameter of the second bottom portion 81 is equal to an outer diameter of the bell extension portion 2*c* of the central portion 2 (see FIG. 3A).

The first rib 82 and the second rib 83 are rib-shaped parts and have an annular shape as viewed from above the second bottom portion 81. The first rib 82 has an inner diameter greater than an outer diameter of the second rib 83. The first rib 82 and the second rib 83 are disposed concentrically. In addition, a height of the second rib 83 from the second bottom portion 81 is higher than a height of the first rib 82 from the second bottom portion 81.

As shown in FIG. 7C, the first sensor 41 is a sensor for detecting displacement of the central portion 2 (see FIG. 3B). The first sensor 41 is formed of a membrane switch. The first sensor 41 is formed in an annular shape such that the first rib 82 fits into an inner circumferential side of the first sensor 41. Further, the first sensor 41 has an outer diameter smaller than the outer diameter of the second bottom portion 81.

The elastic member 43 is a member formed of a sponge. The elastic member 43 is formed in an annular shape such that the first rib 82 fits into an inner circumferential side of the elastic member 43. Further, the elastic member 43 has an outer diameter smaller than the outer diameter of the first sensor 41.

The interposed member 50 is formed of an elastically deformable film. The interposed member 50 is formed in an annular shape such that the second rib 83 fits into an inner circumferential side of the interposed member 50. Further, the interposed member 50 has an outer diameter equal to the outer diameter of the bell extension portion 2*c* (see FIG. 3B).

The second sensor 42 is a sensor for detecting vibration of the second frame 32. The second sensor 42 is formed of a piezoelectric element. The second sensor 42 is pasted on the lower surface side of the second frame 32 by double-sided tape.

Next, an arrangement of the first sensor 41, the second sensor 42, the elastic member 43 and the interposed member 50 with respect to the second frame 32 is described.

As shown in FIG. 7C, the inner circumferential side of the first sensor 41 fits the outside of the first rib 82. Thus, the first sensor 41 is placed on a part on the upper surface side (upper side in FIG. 7C) of the second bottom portion 81 located on an outer circumferential side of the first rib 82.

The elastic member 43 fits the outside of the first rib 82 while the first sensor 41 is placed on the second bottom portion 81. Thus, the elastic member 43 is placed on the upper surface side of the first sensor 41.

The interposed member 50 fits the outside of the second rib 83 while the first sensor 41 and the elastic member 43 are placed on the second bottom portion 81. Thus, a lower surface side of the interposed member 50 is placed on an upper end part of the first rib 82.

In this way, while the first sensor 41 and the elastic member 43 fit the outside of the first rib 82, the interposed member 50 fits the outside of the second rib 83 formed concentric with the first rib 82. Therefore, the first sensor 41, the elastic member 43 and the interposed member 50 can be disposed concentrically.

Further, displacement of the first sensor 41 and the elastic member 43 in a direction perpendicular to an axial direction (height direction of the first sensor 41 and the elastic member 43, vertical direction in FIG. 7C) is restricted by the first rib 82. Displacement of the interposed member 50 in a direction perpendicular to the axial direction (height (thickness) direction of the interposed member 50, vertical direction in FIG. 7C) is restricted by the second rib 83. Accordingly, the first sensor 41, the elastic member 43 and the interposed member 50 can be prevented from being displaced relative to each other in forward, backward, leftward and rightward directions (horizontal direction and direction perpendicular to the paper surface of FIG. 7C).

Moreover, while placed on the upper surface side of the first sensor 41, the elastic member 43 has a height from the second bottom portion 81 lower than the height of the first rib 82 from the second bottom portion 81. Accordingly, by placing the interposed member 50 on an upper end part of the first rib 82, the interposed member 50 can be supported in an elastically deformable manner while spaced from the elastic member 43.

As described above, when the first sensor 41, the elastic member 43 and the interposed member 50 are mounted on the second frame 32, they are adapted to fit the first rib 82 or the second rib 83. As a result, these components can be mounted at appropriate positions, thereby simplifying the mounting process.

Figure 8B:
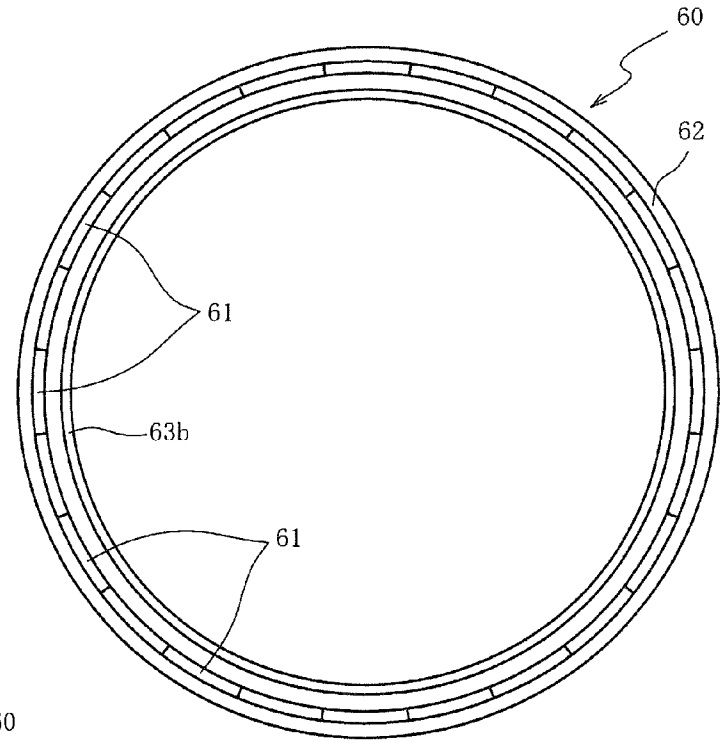
FIG. 8B is a bottom view of the connection ring.
Figure 8A:
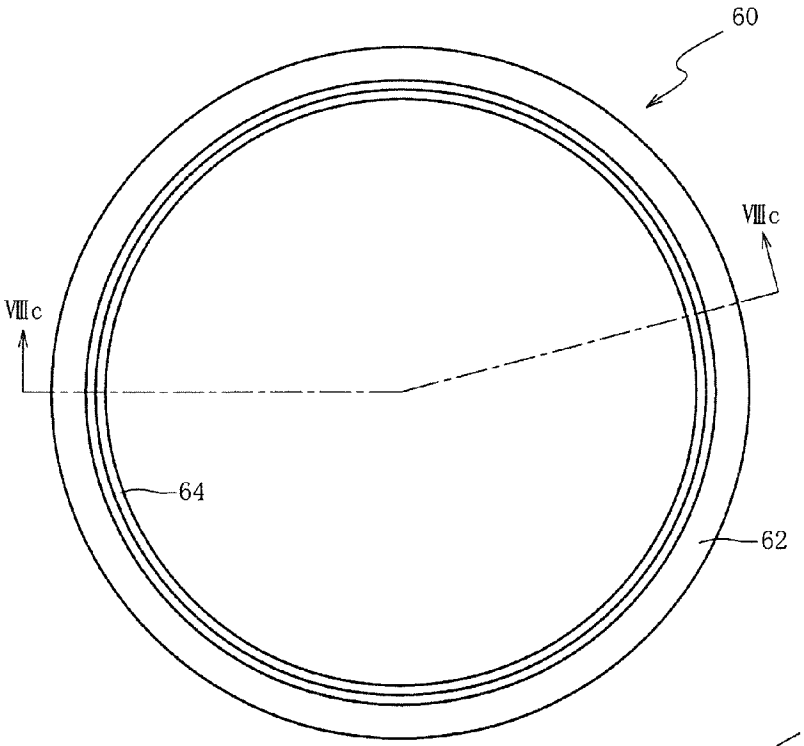
FIG. 8A is a top view of a connection ring.
Figure 8C:
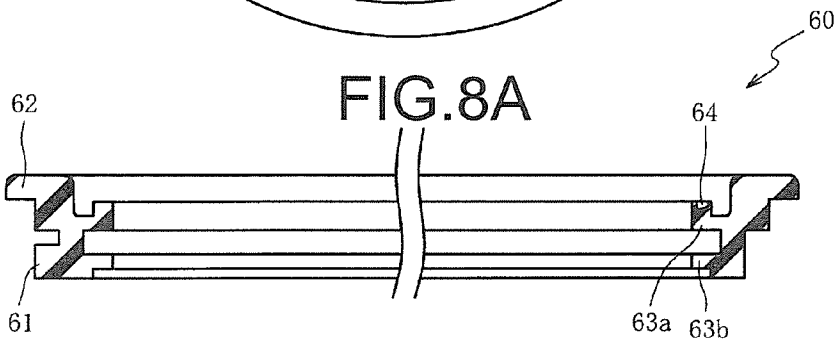
FIG. 8C is a cross-sectional view of the connection ring taken on line VIIIc-VIIIc in FIG. 8A.

Next, the connection ring 60 is described with reference to FIGS. 8A to 8C. FIG. 8A is a top view of the connection ring 60. FIG. 8B is a bottom view of the connection ring 60. FIG. 8C is a cross-sectional view of the connection ring 60 taken on line VIIIc-VIIIc in FIG. 8A.

As shown in FIG. 8A to 8C, the connection ring 60 is a member for connecting the first frame 31, the second frame 32 and the annular portion 3 to each other. The connection ring 60 is formed of a rubbery elastic body. In addition, an outer diameter of an outer circumferential surface of the connection ring 60 is substantially equal to the inner diameter of the bow extension portion 3*c* of the annular portion 3 and the inner diameter of the outer circumferential upright portion 73 of the first frame 31.

The connection ring 60 includes a plurality of outer circumferential convex portions 61, a bow support portion 62, a pair of holding portions 63*a* and 63*b*, and a restricting portion 64. The plurality of the outer circumferential convex portions 61 are formed protruding on the outer circumferential surface of the connection ring 60 while extending circumferentially. The bow support portion 62 is formed in a flange shape extending radially outward from the outer circumferential surface located above the plurality of the outer circumferential convex portions 61. The pair of the holding portions 63*a* and 63*b* protrudes radially inward from an inner circumferential surface of the connection ring 60 while extending circumferentially with a space formed therebetween in the vertical direction. The restricting portion 64 protrudes upward from the holding portion 63*a* located at an upper side (upper side in FIG. 8C) among the pair of the holding portions 63*a* and 63*b*.

The outer circumferential convex portions 61 are formed on the connection ring 60 in the same number (twelve in the present embodiment) as the inner circumferential convex portions 73*a*. The outer circumferential convex portion 61 has an outer diameter smaller than the inner diameter of the outer circumferential upright portion 73 and greater than an inner diameter of the inner circumferential convex portion 73*a*. Further, the outer diameter of the outer circumferential surface of the connection ring 60 is smaller than the inner diameter of the inner circumferential convex portion 73*a*. A space (length along the circumferential direction of the connection ring 60) between two adjacent outer circumferential convex portions 61 on the connection ring 60 is greater than a length along a circumferential direction of the inner circumferential convex portion 73*a*. Further, a length along a circumferential direction of the outer circumferential convex portion 61 is smaller than a space (length along the circumferential direction of the outer circumferential upright portion 73) between two adjacent inner circumferential convex portions 73*a*.

The bow support portion 62 is constituted by two parts having different outer diameters. The smaller-diameter part of the two parts having different outer diameters that is formed at a lower side (lower side in FIG. 8C) has an outer diameter equal to the outer diameter of the outer circumferential convex portion 61.

The greater-diameter part of the two parts that is formed at an upper side (upper side in FIG. 8C) has an outer diameter equal to an outer diameter of the outer circumferential upright portion 73 of the first frame 31 (see FIG. 3B).

Moreover, a gap is formed between a lower surface of the smaller-diameter part of the bow support portion 62 and an upper surface of the outer circumferential convex portion 61.

The gap is slightly larger than a vertical width (size in the vertical direction in FIG. 6C) of the inner circumferential convex portion 73*a* of the first frame 31.

Here, a method of connecting the first frame 31 and the annular portion 3 to the connection ring 60 is described with reference back to FIGS. 3A and 3B.

First, the first frame 31, the connection ring 60 and the annular portion 3 are disposed concentrically. Next, the first frame 31 is disposed below the connection ring 60. Further, the annular portion 3 is disposed between the connection ring 60 and the first frame 31. Accordingly, an upper surface of the bow extension portion 3*c* of the annular portion 3 is disposed opposed to a lower surface of the greater-diameter part of the bow support portion 62 of the connection ring 60. A lower surface of the bow extension portion 3*c* is disposed opposed to an upper end surface of the outer circumferential upright portion 73 of the first frame 31 (see FIG. 4).

Next, in such state, relative positions of the first frame 31 and the connection ring 60 in the circumferential direction are adjusted such that the inner circumferential convex portion 73*a* of the first frame 31 passes between two adjacent outer circumferential convex portions 61 on the connection ring 60. Then, the first frame 31 is moved up to a position where the upper end surface of the outer circumferential upright portion 73 touches the lower surface of the greater-diameter part of the bow support portion 62 via the bow extension portion 3*c*. In this way, the inner circumferential convex portion 73*a* is disposed upper than the outer circumferential convex portion 61. Further, the bow extension portion 3*c* is sandwiched by the greater-diameter part of the bow support portion 62 and the outer circumferential upright portion 73.

Next, in the state that the inner circumferential convex portion 73*a* is disposed upper than the outer circumferential convex portion 61, the first frame 31 is relatively rotated with respect to the connection ring 60. Further, the inner circumferential convex portion 73*a* is inserted into the gap between the outer circumferential convex portion 61 and the smaller-diameter part of the bow support portion 62.

Accordingly, the inner circumferential convex portion 73*a* is held between the outer circumferential convex portion 61 and the smaller-diameter part of the bow support portion 62, so as to connect the first frame 31 to the connection ring 60.

Further, the bow extension portion 3*c* is held between the greater-diameter part of the bow support portion 62 and the upper end surface of the outer circumferential upright portion 73, so as to connect the annular portion 3 to the connection ring 60.

Moreover, a stopper (not illustrated) installed to extend upward from one end side in the circumferential direction of one or a plurality of the outer circumferential convex portions 61 is formed on the outer circumferential surface of the connection ring 60. When the inner circumferential convex portion 73*a* is inserted into the gap between the outer circumferential convex portion 61 and the smaller-diameter part of the bow support portion 62, and the first frame 31 is relatively rotated with respect to the connection ring 60 until relative positions of the outer circumferential convex portion 61 and the inner circumferential convex portion 73*a* in the circumferential direction coincide, the inner circumferential convex portion 73*a* touches the stopper. Accordingly, the first frame 31 is prevented from being relatively rotated any further with respect to the connection ring 60.

That is, it can be perceived that by rotating the first frame 31 until the relative rotation of the first frame 31 with respect to the connection ring 60 is restricted, the inner circumferential convex portion 73*a* and the outer circumferential convex portion 61 fit each other (the relative positions of the inner circumferential convex portion 73*a* and the outer circumferential convex portion 61 in the circumferential direction coincide with each other). As a result, the first frame 31 can be securely connected to the connection ring 60.

In this way, a bolt or adhesive or the like is not required for connecting the first frame 31 and the annular portion 3 to the connection ring 60. In addition, by connecting the first frame 31 and the annular portion 3 to the connection ring 60, the first frame 31 and the annular portion 3 can be disposed concentrically. Accordingly, an assembling process of the electronic cymbal 100 can be simplified.

Here, in the present embodiment, the inner circumferential convex portion 73*a* and the outer circumferential convex portion 61 are installed to extend along the circumferential direction of the outer circumferential upright portion 73 or the connection ring 60. However, each inner circumferential convex portion 73*a* and each outer circumferential convex portion 61 may also be slightly inclined with respect to a horizontal direction (horizontal direction in FIG. 6C and in FIG. 8C) such that a plurality of the inner circumferential convex portions 73*a* and a plurality of the outer circumferential convex portions 61 form a spiral shape as a whole. In such case, by relatively rotating the first frame 31 with respect to the connection ring 60, the inner circumferential convex portions 73*a* and the outer circumferential convex portions 61 are connected to each other by screwing. In this way, the first frame 31 can be strongly connected to the connection ring 60. Moreover, in such case, the inner circumferential convex portions 73*a* or the outer circumferential convex portions 61 may also be configured as a single continuously circumferentially formed part.

In addition, the first frame 31, the second frame 32 and the annular portion 3 can be connected to each other by the connection ring 60. Thus, a number of members of the electronic cymbal 100 can be decreased.

While the first frame 31 and the annular portion 3 are connected by the connection ring 60, it is preferable that an upper end surface of the connection ring 60 be disposed to be in a same surface with the bow portion 3*a* of the annular portion 3, or be disposed lower than the inner circumferential part (part on which the inclined portion 3*b* is installed consecutively) of the bow portion 3*a*. In this way, the electronic cymbal 100 can be improved in appearance as viewed from an upper surface side. Further, the connection ring 60 can avoid being struck by mistake during playing of the electronic cymbal 100.

The pair of the holding portions 63*a* and 63*b* and the restricting portion 64 are described with reference back to FIG. 8C. A gap that allows insertion of an outer circumferential part of the second bottom portion 81 (see FIG. 7B) of the second frame 32 thereinto is formed between the pair of the holding portions 63*a* and 63*b*. By inserting the outer circumferential part of the second bottom portion 81 into the gap, the second bottom portion 81 is held by the pair of the holding portions 63*a* and 63*b*. As a result, the second frame 32 is connected to the connection ring 60.

The restricting portion 64 is an annular part for restricting the central portion 2 from swinging beyond a predetermined extent. The restricting portion 64 has an outer diameter equal to the outer diameter of the bell extension portion 2*c* of the central portion 2.

Next, relationships between the components of the electronic cymbal 100 are described with reference back to FIGS. 3A and 3B. While the electronic cymbal 100 is supported by the cymbal stand 91, the rod 91*a* is inserted into the uniform diameter portion 21*b* of the second ring 20. At this moment, the tapered portion 21*c* is swingably supported by the cymbal support portion 92. Accordingly, the sensor accommodating portion 30 connected to the second ring 20 and the annular portion 3 connected to the sensor accommodating portion 30 are swingably supported by the cymbal stand 91.

In addition, the first ring 10 is swingably supported by the cymbal stand 91 via the second ring 20. Thus, the central portion 2 supported by the first ring 10 is swingably supported by the cymbal stand 91.

Accordingly, when the annular portion 3 is struck to swing with respect to the cymbal stand 91, subsequently, the sensor accommodating portion 30, the second ring 20, the first ring 10 and the central portion 2 swing integrally with the annular portion 3 with respect to the cymbal stand 91.

The felt washer 94 is placed on an upper surface of the second ring 20 while accommodated on an inner circumferential side of the first ring 10. In such state, the felt washer 94 is compressed by screwing the tightening nut 93 on the rod 91*a*. By adjusting a tightening amount of the tightening nut 93 with respect to the rod 91*a*, ease of swinging of the second ring 20 with respect to the rod 91*a* can be adjusted. That is, ease of swinging of the annular portion 3 that is swingably supported by the rod 91*a* via the second ring 20 and the first frame 31 can be adjusted.

In the sensor accommodating portion 30, the second frame 32 is supported by the connection ring 60 while spaced from the first frame 31. That is, the second frame 32 is maintained by the connection ring 60 while a space is provided between an inner circumferential side of the second bottom portion 81 and the inner circumferential upright portion 72, and the second bottom portion 81 is lifted up from the first bottom portion 71.

The restricting portion 64 is located on a further outer circumferential side of the second bottom portion 81 than the first sensor 41. The restricting portion 64 has a height (size in the vertical direction in FIG. 3B) from the second bottom portion 81 higher than a height of the first sensor 41 from the second bottom portion 81, and lower than the height of the elastic member 43 from the second bottom portion 81.

In this way, when there is no displacement of the central portion 2, a space between the bell extension portion 2*c* with the interposed member 50 and the restricting portion 64 is wider than a space between the bell extension portion 2*c* with the interposed member 50 and the elastic member 43. Accordingly, if the central portion 2 is struck, the interposed member 50 touches the elastic member 43 before touching the restricting portion 64. Thus, the first sensor 41 can be pressed by the bell extension portion 2*c* and the interposed member 50 via the elastic member 43.

On the other hand, the space between the bell extension portion 2*c* with the interposed member 50 and the restricting portion 64 is narrower than a space between the bell extension portion 2*c* with the interposed member 50 and the first sensor 41. Accordingly, if the central portion 2 swings beyond a predetermined amount, the bell extension portion 2*c* touches the restricting portion 64 via the interposed member 50. That is, the central portion 2 is restricted from swinging any further. In this way, the first sensor 41 can be prevented from being directly pressed by the bell extension portion 2*c* and the interposed member 50.

The interposed member 50 is installed between the central portion 2 and the first sensor 41 with the elastic member 43. Further, an upper surface side of the interposed member 50 touches a lower surface side of the bell extension portion 2*c* of the central portion 2.

At this moment, while the lower surface side of the interposed member 50 is supported by the first rib 82, a part of the interposed member 50 on a further outer circumferential side than the first rib 82 touches the bell extension portion 2*c*. The outer circumferential part of the interposed member 50 is slightly pushed down by the bell extension portion 2*c*. Accordingly, the interposed member 50 is elastically deformed, and a reaction force acts in a direction of pushing back the bell extension portion 2*c*. Hence, the interposed member 50 is kept touching the bell extension portion 2*c*.

Therefore, when the central portion 2 is in a motionless state, i.e. when no strike is being made on the central portion 2, swinging of the central portion 2 and the interposed member 50 can be suppressed. Accordingly, false detection by the first sensor 41 and the second sensor 42 that occurs while no strike is being made on the central portion 2 can be reduced.

Figure 9A:
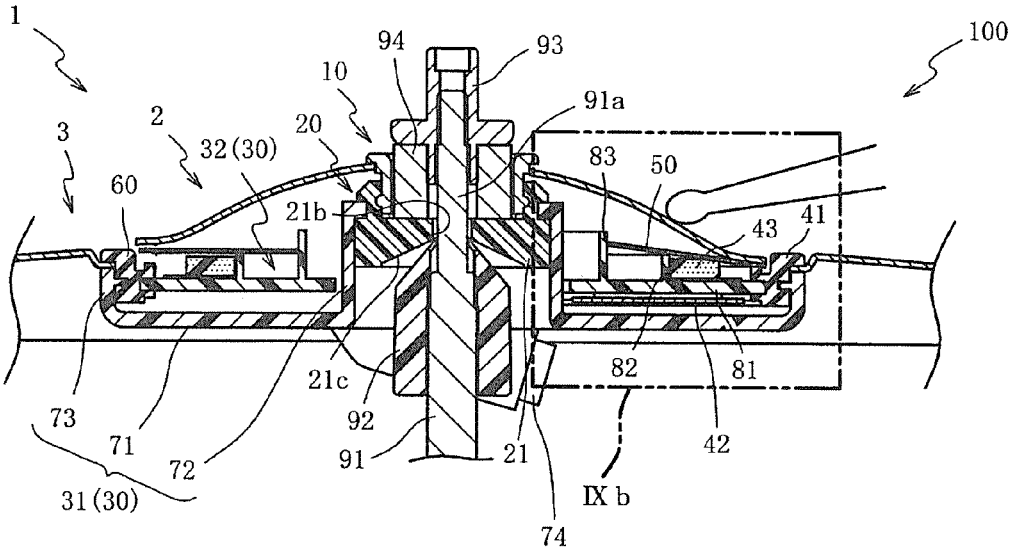
FIG. 9A is a cross-sectional view of the electronic cymbal.
Figure 9B:
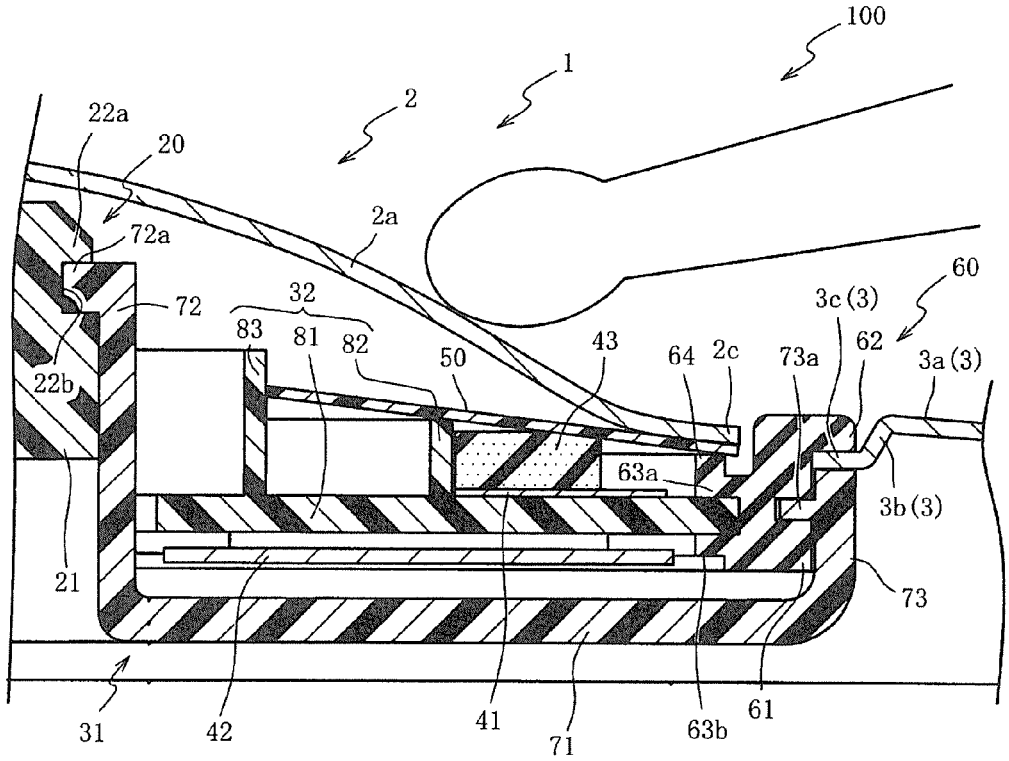
FIG. 9B is a partially enlarged cross-sectional view of the electronic cymbal taken on a part IXb in FIG. 9A.

Next, a method of detecting a strike to the central portion 2 is described with reference to FIGS. 9A and 9B. FIG. 9A is a cross-sectional view of the electronic cymbal 100. FIG. 9B is a partially enlarged cross-sectional view of the electronic cymbal 100 taken on the part IXb in FIG. 9A. Moreover, FIG. 9A illustrates the cross section corresponding to that shown in FIG. 3A, and schematically illustrates a state that the central portion 2 is struck by a stick. In addition, FIG. 9B omits illustration of the jack 74.

First, a method of detecting a strike to the central portion 2 using the first sensor 41 is described.

As shown in FIGS. 9A and 9B, when struck by the stick, the central portion 2 is relatively displaced with respect to the sensor accommodating portion 30, and the struck part of the central portion 2 is pushed down.

Accordingly, the outer circumferential part (part located on a further outer circumferential side than the first rib 82) of the interposed member 50 is pressed by the bell extension portion 2*c* of the central portion 2 to be elastically deformed. The elastic member 43 is pressed by the bell extension portion 2*c* via the interposed member 50 to be elastically deformed. As a result, the first sensor 41 is pressed by the bell extension portion 2*c* via the interposed member 50 and the elastic member 43.

By detecting that the first sensor 41 is pressed, the electronic cymbal 100 determines that the central portion 2 is struck and outputs a detection signal to the sound source apparatus (not illustrated).

At this moment, the central portion 2 presses the elastic member 43 via the interposed member 50. Hence, vibration of the central portion 2 can be attenuated by the elastic member 43. Thus, a percussive sound generated by the strike to the central portion 2 can be reduced.

Further, the central portion 2 presses the first sensor 41 via the interposed member 50 and the elastic member 43. Hence, an impact on the first sensor 41 accompanying the pressing operation can be reduced. Thus, damage to the first sensor 41 due to such impact can be suppressed.

In addition, when the central portion 2 swings beyond the predetermined amount, the central portion 2 touches the restricting portion 64, and is restricted from swinging any further by the restricting portion 64. Thus, damage to the first sensor 41 due to collision with the central portion 2 and the interposed member 50 can be prevented.

Further, the connection ring 60 having the restricting portion 64 formed therein is formed of a rubbery elastic body. Thus, occurrence of noise generated from collision of the bell extension portion 2*c* and the interposed member 50 with the restricting portion 64 can be suppressed.

While the central portion 2 presses the elastic member 43 and the first sensor 41, the interposed member 50 and the elastic member 43 are pushed down by the bell extension portion 2*c* of the central portion 2 to be elastically deformed. Thus, when the stick is separated from the central portion 2 and a pressing force from the central portion 2 to the first sensor 41 is removed, the central portion 2 is quickly pushed back by a reaction force of the interposed member 50 and the elastic member 43. Accordingly, detection accuracy for a strike to the central portion 2 can be improved.

That is, when a strike to the central portion 2 is completed, the central portion 2 is pushed back and the interposed member 50 is quickly lifted up, thus releasing the first sensor 41 from the pressed state. Accordingly, the first sensor 41 can be stopped from outputting the detection signal. Therefore, vibration of the central portion 2 after completion of the strike to the central portion 2 can be prevented from being detected by the first sensor 41.

In addition, the lower surface side of the interposed member 50 is supported by the first rib 82. Consequently, while the interposed member 50 is pressed by the bell extension portion 2*c*, a part supported by the first rib 82 is used as a supporting point and a part located on a further outer circumferential side than the first rib 82 is pushed down to be elastically deformed.

Accordingly, a space between the part pressed by the bell extension portion 2*c* and the supporting point can be reduced compared to a case where the interposed member 50 is pushed down with an inner circumferential part thereof as a supporting point. Thus, the reaction force that acts in the direction of pushing back the bell extension portion 2*c* can be increased.

The bell extension portion 2*c* is formed inclined downward more gradually than the bell portion 2*a*. Further, the interposed member 50 has an outer diameter equal to the outer diameter of the bell extension portion 2*c*. Thus, when the interposed member 50 is pressed by the bell extension portion 2*c*, the interposed member 50 can be easily elastically deformed along the lower surface side of the bell extension portion 2*c*. In such case, a large area of the interposed member 50 is pushed down. As a result, the reaction force that acts in the direction of pushing back the bell extension portion 2*c* can be given to a large area of the bell extension portion 2*c*.

Moreover, by adjusting hardness of the sponge that composes the elastic member 43 or the space between the elastic member 43 and the interposed member 50 while the central portion 2 is in the motionless state, strength of the reaction force that acts in the direction of pushing back the bell extension portion 2*c* and sensitivity of the first sensor 41 can be set.

Here, the first sensor 41 detects that the central portion 2 is struck if the bell extension portion 2*c* is struck to be pushed down a predetermined amount. Accordingly, the sensitivity of the first sensor 41 is subject to a stroke amount (i.e. a displacement of swinging) of the bell extension portion 2*c* required for pressing the first sensor 41 by the bell extension portion 2*c*.

In view of this, the elastic member 43 and the interposed member 50 are formed in an annular shape, and the upper surface of the elastic member 43 and the lower surface of the interposed member 50 are opposed to each other throughout the circumferential direction. Thus, if there is unevenness on the upper surface of the elastic member 43 and the lower surface of the interposed member 50, depending on a position of the elastic member 43 pressed via the interposed member 50, variation occurs in the stroke amount of the bell extension portion 2*c* required for detecting with the first sensor 41 that the central portion 2 is struck. Due to the variation, difference occurs in the sensitivity of the first sensor 41 depending on the struck position on the central portion 2. Accordingly, to improve the detection accuracy for a strike to the central portion 2, the lower surface side of the interposed member 50 is required to exhibit high flatness.

With respect to this, the interposed member 50 is formed of a film. Thus, the interposed member 50 with high flatness can be easily fabricated compared to a case where the interposed member 50 is formed of a molded article made of a rubbery elastic body. As a result, sensitivity error of the first sensor 41 depending on the struck position on the central portion 2 can be suppressed. That is, the detection accuracy for a strike to the central portion 2 can be improved.

Here, in the present embodiment, while no strike is being made on the central portion 2 and the first sensor 41 is not turned on (the first sensor 41 is not being pressed), the lower surface side of the interposed member 50 touches the elastic member 43 (see FIG. 3A). However, while no strike is being made on the central portion 2, the lower surface side of the interposed member 50 may also be configured spaced from the elastic member 43. In such case, the first sensor 41 can be more surely prevented from performing false detection while no strike is being made on the central portion 2.

Next, a method of detecting intensity of a strike to the main body portion 1 using the second sensor 42 is described.

When the central portion 2 or the annular portion 3 is struck and the vibration of the same that occurs with the strike is transmitted to the second frame 32, vibration of the second frame 32 is detected by the second sensor 42. From the vibration of the second frame 32, the second sensor 42 outputs to the sound source apparatus a detecting signal according to intensity of vibration of the strike to the central portion 2 or the annular portion 3. Based on the detecting signal outputted from the second sensor 42, the sound source apparatus determines volume of a musical sound emitted from a speaker or the like (not illustrated).

If the central portion 2 is struck, the vibration of the central portion 2 that occurs with the strike is transmitted from the interposed member 50 to the first rib 82. Further, the vibration transmitted to the first rib 82 is detected by the second sensor 42.

In such case, the vibration transmitted to the second frame 32 can be reduced compared to a case where the central portion 2 directly touches the second frame 32. Thus, damage to the second sensor 42 or falling-off of the second sensor 42 from the second bottom portion 81 due to excessive vibration of the second frame 32 can be suppressed.

Meanwhile, even while no strike is being made on the central portion 2, the interposed member 50 touches the bell extension portion 2*c*. Accordingly, if the central portion 2 is struck, the vibration of the central portion 2 is quickly transmitted to the second frame 32 via the interposed member 50. Therefore, a time lag from when the central portion 2 is struck to when the musical sound is emitted from the speaker or the like (not illustrated) is reduced, and the detection accuracy for a strike to the central portion 2 can be improved.

If the annular portion 3 is struck, the vibration of the annular portion 3 that occurs with the strike is transmitted to the second bottom portion 81 via the connection ring 60. Further, the vibration transmitted to the second bottom portion 81 is detected by the second sensor 42.

In such case, the vibration of the annular portion 3 is attenuated by the connection ring 60 and the attenuated vibration is transmitted to the second bottom portion 81. Thus, damage to the second sensor 42 or falling-off of the second sensor 42 from the second bottom portion 81 due to excessive vibration of the second bottom portion 81 can be suppressed.

Here, if the annular portion 3 and the second bottom portion 81 are connected to each other at only a part in their circumferential direction, length of a path through which vibration is transmitted varies depending on a distance between the connected position and the struck position on the annular portion 3. Hence, difference in the vibration transmitted to the second frame 32 increases depending on the struck position on the annular portion 3 in the circumferential direction.

By contrast, the second bottom portion 81 and the bow extension portion 3*c* of the annular portion 3 are connected to the connection ring 60 throughout the circumferential direction. Thus, as long as distances in the radial direction from the connection ring 60 (distances in the radial direction from the central portion 2) are equal, whatever position in the circumferential direction of the annular portion 3 is struck, lengths of paths through which vibration is transmitted to the second frame 32 are equal. Therefore, sensitivity distribution of the second sensor 42 can be made uniform.

In addition, the first frame 31 and the second frame 32 of the sensor accommodating portion 30 are connected by the connection ring 60. Further, the second frame 32 is supported by the pair of the holding portions 63*a* and 63*b* of the connection ring 60 while spaced from the first frame 31. Accordingly, the vibration of the first frame 31 can be prevented from being directly transmitted to the second frame 32.

The first frame 31 is supported by the cymbal stand 91 via the second ring 20. Meanwhile, the cymbal stand 91 maintains the electronic cymbal 100 at a desired height position from a floor surface. At this moment, generally, a percussion instrument such as a drum or a speaker is disposed on the floor surface around the cymbal stand 91.

Accordingly, during the playing of the electronic cymbal 100, the floor surface easily vibrates, and the vibration is also transmitted to the cymbal stand 91. Further, vibration of the cymbal stand 91 is transmitted to the second frame 32 via the first frame 31. Accordingly, while no strike is being made on the main body portion 1, vibration of the second frame 32 is detected by the second sensor 42. As a result, it is sometimes determined by mistake that the main body portion 1 is struck.

With respect to this, the first frame 31 and the second frame 32 are connected by the connection ring 60 formed of a rubbery elastic body. Accordingly, the vibration of the first frame 31 can be suppressed by the connection ring 60 from being transmitted to the second frame 32. In addition, the second frame 32 is supported while spaced from the first frame 31. Accordingly, direct transmission of the vibration of the first frame 31 to the second frame 32 without via the connection ring 60 can be prevented.

Therefore, false detection by the second sensor 42 due to the vibration of the cymbal stand 91 can be suppressed. That is, detection accuracy for a strike to the main body portion 1 can be improved.

Moreover, the electronic cymbal 100 is swingably supported by the cymbal stand 91. Hence, the connector cable (not illustrated) connected to the jack 74 vibrates as the electronic cymbal 100 swings.

With respect to this, the jack 74 is disposed at the first frame 31 of the sensor accommodating portion 30. Accordingly, vibration due to swinging of the connector cable can be suppressed from being transmitted to the second frame 32. That is, the second sensor 42 can be prevented from performing false detection.

Next, the second embodiment is described. In the first embodiment, the first sensor 41 and the second sensor 42 are accommodated by the sensor accommodating portion 30. The second embodiment illustrates a case where the second sensor 42 is accommodated by a sensor accommodating portion 230 and accommodation of the first sensor 41 is omitted. The same reference numerals denote the same parts as those in the above embodiment, and descriptions thereof are omitted.

Figure 10A:
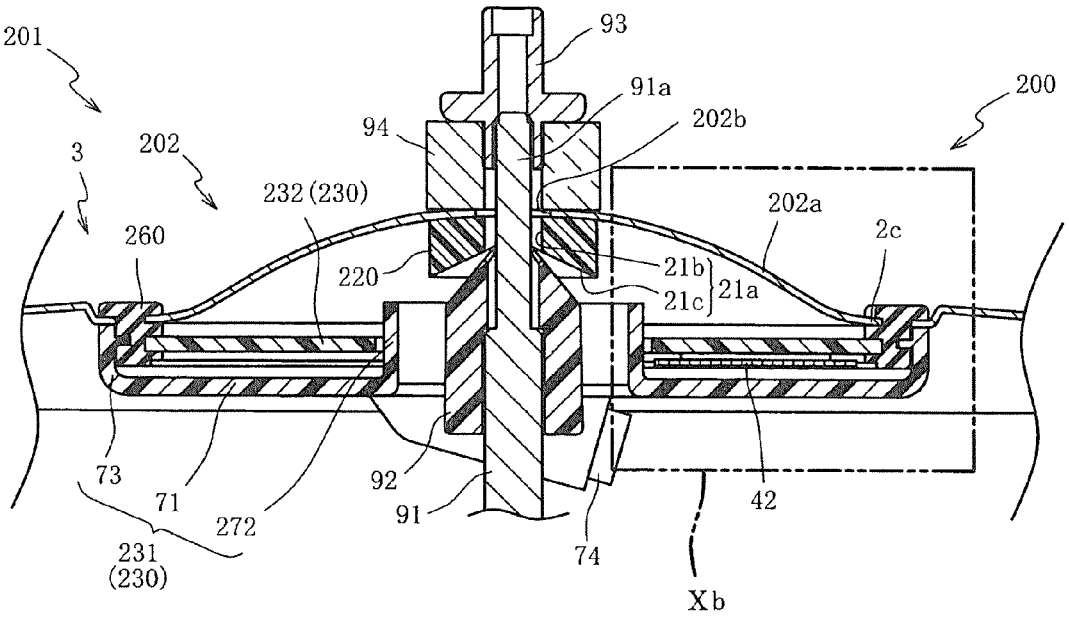
FIG. 10A is a cross-sectional view of an electronic cymbal according to the second embodiment.
Figure 10B:
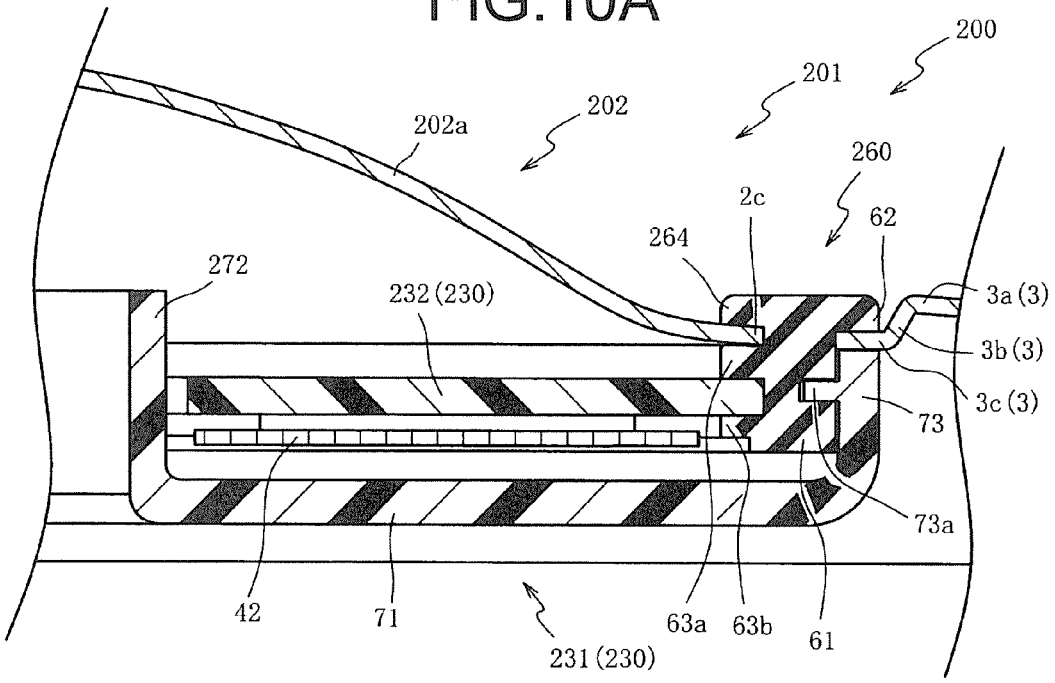
FIG. 10B is a partially enlarged cross-sectional view of the electronic cymbal taken on a part Xb in FIG. 10A.

FIG. 10A is a cross-sectional view of an electronic cymbal 200 according to the second embodiment. FIG. 10B is a partially enlarged cross-sectional view of the electronic cymbal 200 taken on the part Xb in FIG. 10A. Moreover, FIG. 10A illustrates the cross section corresponding to that shown in FIG. 3A. In addition, FIG. 10B omits illustration of the jack 74.

As shown in FIGS. 10A and 10B, the electronic cymbal 200 mainly includes a main body portion 201, a second ring 220, the second sensor 42, the sensor accommodating portion 230 and a connection ring 260. The main body portion 201 is constituted by a central portion 202 and the annular portion 3. The second ring 220 supports the central portion 202 from below. The second sensor 42 is accommodated by the sensor accommodating portion 230. The connection ring 260 connects the sensor accommodating portion 230 to the main body portion 201.

The central portion 202 includes a bell portion 202*a*, an insertion hole 202*b* and the bell extension portion 2*c*. The insertion hole 202*b* is a hole that allows insertion of the rod 91*a* thereinto. The central portion 202 is swingably supported by the rod 91*a* while sandwiched between the second ring 220 and the felt washer 94 with the rod 91*a* being inserted into the insertion hole 202*b*.

The second ring 220 is a part swingably supported by the cymbal support portion 92. An upper surface side of the second ring 220 is formed in a planar shape. Further, the second ring 220 is formed of a resin material capable of being elastically deformed along a shape of a lower surface side of the bell portion 202*a*.

The sensor accommodating portion 230 includes a first frame 231 and a second frame 232. The first frame 231 and the second frame 232 are connected by the connection ring 260.

The first frame 231 includes the first bottom portion 71, an inner circumferential upright portion 272 and the outer circumferential upright portion 73. The jack 74 is disposed at the first bottom portion 71. The inner circumferential upright portion 272 has an inner diameter greater than an outer diameter of the second ring 220.

The second frame 232 is an annular member formed of a resin material. The second frame 232 is formed to be accommodated between the inner circumferential upright portion 272 and the outer circumferential upright portion 73 of the first frame 31. That is, the second frame 232 has an inner diameter greater than an outer diameter of the inner circumferential upright portion 272, and has an outer diameter smaller than the inner diameter of the outer circumferential upright portion 73.

The connection ring 260 is an annular member formed of a rubbery elastic body. The connection ring 260 includes the outer circumferential convex portion 61, the bow support portion 62, a pair of the holding portions 63*a* and 63*b*, and a bell holding portion 264. The bell holding portion 264 holds the bell extension portion 2*c* of the central portion 202.

The bell holding portion 264 is formed protruding radially inward from an inner circumferential surface of the connection ring 260 located on an upper end part thereof. A gap is formed between an upper surface of the holding portion 63*a* that is located at the upper side among the pair of the holding portions 63*a* and 63*b* and a lower surface of the bell holding portion 264. The gap is formed to allow insertion of the bell extension portion 2*c* thereinto. By inserting the bell extension portion 2*c* between the holding portion 63*a* and the bell holding portion 264, the bell extension portion 2*c* is held by the holding portion 63*a* and the bell holding portion 264.

In the electronic cymbal 200, when the central portion 202 is struck, vibration thereof is transmitted to the second frame 232 via the connection ring 260. The vibration transmitted to the second frame 232 is detected by the second sensor 42.

Accordingly, the vibration of the central portion 202 is transmitted to the second frame 232 while having been attenuated by the connection ring 260. Therefore, the vibration transmitted to the second frame 232 can be reduced compared to a case where the central portion 202 directly touches the second frame 232. Accordingly, damage to the second sensor 42 or falling-off of the second sensor 42 from the second frame 232 due to excessive vibration of the second frame 232 can be suppressed.

In addition, the central portion 202 is held by the holding portion 63*a* and the bell holding portion 264 of the connection ring 260 formed of a rubbery elastic body. Thus, a percussive sound generated by the strike to the central portion 202 can be reduced.

Moreover, the connection ring 260 is radially divided at one position in a circumferential direction. Thus, a mounting process of the connection ring 260 onto the bell extension portion 2*c* can be simplified and elasticity of the connection ring 260 is freely adjustable compared to a case where the connection ring 260 is formed in an endless shape.

If the connection ring is formed in an endless shape, it is necessary to elastically deform the connection ring so as to fit the central portion 202 into an inner circumferential side of the connection ring. For that reason, the elasticity of the connection ring has to be set rather high.

On the other hand, if the elasticity of the connection ring is too high, the vibration caused by the strike to the central portion 202 and the annular portion 3 is hardly transmitted to the second frame 232. As a result, it is sometimes difficult to detect the vibration of the second frame 232 using the second sensor 42.

With respect to this, the connection ring 260 is radially divided at one position in the circumferential direction. Therefore, the connection ring 260 can be easily deformed and smoothly mounted onto the bell extension portion 2*c*. Also, the elasticity of the connection ring 260 can thus be freely adjusted. As a result, the second sensor 42 can detect the vibration of the strike to the central portion 202 with high precision.

In addition, the first frame 231 and the second frame 232 are connected by the connection ring 260. Accordingly, the vibration of the first frame 231 can be suppressed by the connection ring 260 from being transmitted to the second frame 232. In addition, the second frame 232 is supported while spaced from the first frame 231. Accordingly, direct transmission of the vibration of the first frame 231 to the second frame 232 without via the connection ring 260 can be prevented.

Therefore, false detection by the second sensor 42 due to the vibration of the cymbal stand 91 can be suppressed. That is, the detection accuracy for a strike to the main body portion 201 can be improved.

The above illustrates the present invention on the basis of the embodiments. However, it should be understood that the present invention is not limited to any of the embodiments, and various modifications or alterations may be made without departing from the spirit of the present invention.

In the above embodiments, the sensor accommodating portions 30 and 230 include the first frames 31 and 231 respectively and the second frames 32 and 232 respectively. The first frames 31 and 231 are connected by the connection rings 60 and 260 respectively to the second frames 32 and 232. However, the sensor accommodating portion may also be formed of a single member integrally formed with the first frame and the second frame.

In the above embodiments, the lower surface side of the bow extension portion 3*c* is supported by the upper end surface of the outer circumferential upright portion 73. However, the lower surface side of the bow extension portion 3*c* may also be supported by a part of the connection rings 60 and 260.

Specifically, a height position of the upper end surface of the outer circumferential upright portion may be set lower than that of the outer circumferential upright portion 73 in the first and the second embodiments, and another rubbery elastic body different from the connection rings 60 and 260 may be disposed between the bow extension portion 3*c* and the upper end surface of the outer circumferential upright portion. Alternatively, instead of disposing another rubbery elastic body, the outer diameter of the smaller-diameter part of the bow support portion may be set equal to the outer diameter of the bow extension portion 3*c*, and the smaller-diameter part of the bow support portion may be disposed between the bow extension portion 3*c* and the upper end surface of the outer circumferential upright portion. In addition, a part equivalent to the outer circumferential upright portion 73 in the first or the second embodiment may be configured as a part of the connection ring, the outer circumferential upright portion 73 of the first frame may be omitted, and the outer circumferential part of the first bottom portion 71 may be maintained by the connection ring.

In this manner, since the lower surface side of the bow extension portion 3*c* is supported by the connection ring, the vibration of the bell extension portion 2*c* can be easily attenuated at an early stage.

In addition, in the above first embodiment, the sensor accommodating portion 30 includes the first frame 31 and the second frame 32, wherein the first sensor 41, the elastic member 43 and the interposed member 50 are disposed at the second frame 32. However, the second frame 32 may be omitted, the first rib 82 and the second rib 83 may be formed on the first bottom portion of the first frame, and the first sensor 41, the elastic member 43 and the interposed member 50 may also be disposed thereon. Accordingly, a number of members can be decreased.

In the above first embodiment, the second sensor 42 is accommodated by the sensor accommodating portion 30. However, the second sensor 42 may also be mounted outside the sensor accommodating portion 30, e.g., on a lower surface side of the annular portion 3.

In the above first embodiment, the connection ring 60 includes the restricting portion 64. However, the restricting portion 64 may also be formed separately from the connection ring 60. For example, the restricting portion having an annular shape may be disposed on a further outer circumferential side of the second frame than the position where the elastic member 43 is disposed.

In the above first embodiment, the elastic member 43 has an outer diameter smaller than the outer diameter of the first sensor 41. However, the outer diameter of the elastic member 43 may also be equal to or greater than the outer diameter of the first sensor 41.

If the outer diameter of the elastic member 43 is equal to the outer diameter of the first sensor 41, the elastic member 43 and the first sensor 41 may be disposed on an inner circumferential side of the restricting portion 64. Accordingly, displacement of the elastic member 43 and the first sensor 41 in a direction perpendicular to the vertical direction can be restricted by the restricting portion 64.

In the above first embodiment, the first rib 82 and the second rib 83 are installed upright on the second bottom portion 81 of the second frame 32. However, a rib extension portion may be installed consecutively on the upper end or an inner circumferential surface of the first rib 82 while extending radially inward, and the second rib may be installed upright on an upper surface side of the rib extension portion.

In the above first embodiment, the interposed member 50 is placed on the upper end of the first rib 82. However, a rib extension portion may be installed to extend radially inward from the upper end of the first rib 82 or radially outward from an outer circumferential surface of the second rib 83, and the interposed member 50 may be placed on an upper surface of the rib extension portion.

In the above first embodiment, the first rib 82 and the second rib 83 are formed in an annular shape as viewed from above the second bottom portion 81. However, the first rib 82 or the second rib 83 may also be formed into a plurality of arc shapes.

In the above second embodiment, the first frame 231 is constituted by the first bottom portion 71, the inner circumferential upright portion 272 and the outer circumferential upright portion 73. However, the first frame may also be constituted by the outer circumferential upright portion 73, and may have a shape excluding the first bottom portion 71 and the inner circumferential upright portion 272. Or, the first frame may be constituted by the first bottom portion 71 and the outer circumferential upright portion 73, and may have a shape excluding the inner circumferential upright portion 272. Accordingly, the first frame may be reduced in weight. Therefore, when struck, the cymbal can easily swing with respect to the cymbal stand 91.

What is claimed is:

1. An electronic cymbal, comprising:

an annular portion in an annular shape having predetermined rigidity;

a central portion having predetermined rigidity, located on an inner circumferential side of the annular portion and configured separately from the annular portion;

a sensor portion comprising a first sensor that detects displacement of the central portion;

a support supporting the sensor portion while swingably maintaining the central portion; and an interposed member formed of a film, installed between a lower surface of the central portion and the sensor portion while elastically deformably supported by the support, wherein by displacing the central portion from a motionless state, the sensor portion is pressed by an outer circumferential part of the central portion via the interposed member.

2. The electronic cymbal of claim 1, wherein when the central portion is in the motionless state, the interposed member touches the outer circumferential part of the central portion.

3. The electronic cymbal of claim 1, wherein the support comprises a first restricting portion restricting displacement of the sensor portion in a direction perpendicular to a height direction, and a second restricting portion restricting displacement of the interposed member in the direction perpendicular to the height direction.

4. The electronic cymbal of claim 3, wherein the support comprises a bottom portion disposed with its upper surface side opposed to a lower surface of the central portion, the first restricting portion and the second restricting portion are concentrically disposed protruding on the bottom portion, the first restricting portion is formed to have an inner diameter greater than an outer diameter of the second restricting portion, and a height of the first restricting portion from the bottom portion of the support is set lower than a height of the second restricting portion from the bottom portion of the support.

5. The electronic cymbal of claim 1, wherein the sensor portion comprises an elastic member formed of an elastic material and disposed on an upper surface side of the first sensor opposed to the interposed member.

6. The electronic cymbal of claim 5, comprising a displacement restricting portion disposed below the interposed member, wherein the displacement restricting portion is configured such that when the central portion is in the motionless state, a space between the displacement restricting portion and the interposed member is narrower than a space between the first sensor and the interposed member and wider than a space between the elastic member and the interposed member.

7. The electronic cymbal of claim 1, wherein the support comprises a bottom portion disposed with its upper surface side opposed to a lower surface of the central portion, and a protruding portion protruding from the upper surface side of the bottom portion and extending in an annular or arc shape;

the sensor portion is disposed on an outer circumferential side of the protruding portion and configured to have a height from the bottom portion lower than a height of the protruding portion from the bottom portion; and the interposed member is formed to have an outer diameter greater than an outer diameter of the protruding portion, and when an outer circumferential part of the interposed member is projected further outward than the protruding portion, a lower surface side of the interposed member is supported by an upper end of the protruding portion.

8. The electronic cymbal of claim 1, comprising a second sensor detecting vibration of the support, wherein the support comprises:

a first frame comprising an insertion portion that allows insertion of a cymbal stand thereinto;

a second frame configured separately from the first frame; and a connection portion formed of an elastic material, connecting the first frame and the second frame, wherein the second sensor is mounted on the second frame.

9. The electronic cymbal of claim 8, wherein the second frame is supported by the connection portion while spaced from the first frame.

10. The electronic cymbal of claim 8, wherein the second frame of the support is connected to the annular portion by the connection portion.

11. The electronic cymbal of claim 8, comprising a jack electrically connecting the first sensor or the second sensor to one end of a connector cable, wherein another end of the connector cable is connected to a sound source apparatus that generates a musical sound based on a detection result of the first sensor or the second sensor, wherein the jack is mounted on the first frame.

12. An electronic cymbal, comprising:

an annular portion in an annular shape having predetermined rigidity;

a central portion having predetermined rigidity, located on an inner circumferential side of the annular portion and configured separately from the annular portion;

a sensor portion comprising at least one sensor that detects vibration caused by a strike to at least one of the central portion and the annular portion;

a sensor accommodating portion supporting the sensor portion while swingably maintaining the central portion; and a connection portion formed of an elastic material, connecting the sensor accommodating portion and the annular portion.

13. The electronic cymbal of claim 12, wherein the sensor accommodating portion comprises a first frame comprising an insertion portion that allows insertion of a cymbal stand thereinto, and a second frame configured separately from the first frame, wherein the sensor is mounted on the second frame.

14. The electronic cymbal of claim 13, wherein the second frame is supported by the connection portion while spaced from the first frame.

15. The electronic cymbal of claim 12, wherein the sensor accommodating portion is connected to the central portion by the connection portion.

16. The electronic cymbal of claim 13, wherein the first frame comprises a first bottom portion, an inner circumferential upright portion installed upright on an inner circumferential part of the first bottom portion, and an outer circumferential upright portion installed upright on an outer circumferential part of the first bottom portion; and the second frame is formed to be accommodated by the inner circumferential upright portion and the outer circumferential upright portion of the first frame.

17. The electronic cymbal of claim 13, wherein while the first frame and the annular portion are connected by the connection portion, an upper end surface of the connection portion is disposed to be in a same surface with an upper end surface of the annular portion or is disposed lower than an inner circumferential part of the annular portion.

18. The electronic cymbal of claim 13, wherein the second frame and the annular portion are connected to the connection portion throughout a circumferential direction.

19. The electronic cymbal of claim 12, wherein the connection portion is radially divided at one position in a circumferential direction.

20. The electronic cymbal of claim 13, comprising a jack electrically connecting the sensor to one end of a connector cable, wherein another end of the connector cable is connected to a sound source apparatus that generates a musical sound based on a detection result of the sensor, wherein the jack is mounted on the first frame.

* * * * *